US012043887B2

(12) United States Patent
Ahmed et al.

(10) Patent No.: US 12,043,887 B2
(45) Date of Patent: Jul. 23, 2024

(54) HIGH STRENGTH 6XXX ALUMINUM ALLOYS AND METHODS OF MAKING THE SAME

(71) Applicant: Novelis Inc., Atlanta, GA (US)

(72) Inventors: Hany Ahmed, Atlanta, GA (US); Wei Wen, Allison Park, PA (US); Corrado Bassi, Valais (CH); Aude Despois, Valais (CH); Guillaume Florey, Valais (CH); Xavier Varone, Champlan (CH)

(73) Assignee: Novelis Inc., Atlanta, GA (US)

( * ) Notice: Subject to any disclaimer, the term of this patent is extended or adjusted under 35 U.S.C. 154(b) by 728 days.

(21) Appl. No.: 16/682,834

(22) Filed: Nov. 13, 2019

(65) Prior Publication Data

US 2020/0080182 A1 Mar. 12, 2020

Related U.S. Application Data

(62) Division of application No. 15/381,776, filed on Dec. 16, 2016, now Pat. No. 10,513,766.

(Continued)

(51) Int. Cl.

*C22F 1/05* (2006.01)
*C22C 21/04* (2006.01)

(Continued)

(52) U.S. Cl.

CPC ..... *C22F 1/05* (2013.01); *C22C 21/04* (2013.01); *C22C 21/06* (2013.01); *C22C 21/08* (2013.01);

(Continued)

(58) Field of Classification Search

CPC .. C22F 1/04; C22F 1/043; C22F 1/047; C22F 1/05; C22F 1/057; C22F 1/002;

(Continued)

(56) References Cited

U.S. PATENT DOCUMENTS 4,174,232 A 11/1979 Lenz et al.
4,589,932 A 5/1986 Park (Continued)

FOREIGN PATENT DOCUMENTS

CA 2372736 11/2000
CA 2810251 3/2012

(Continued)

OTHER PUBLICATIONS

Chinese Application No. 201680074145.3, Office Action, mailed Feb. 3, 2021, 17 pages.

(Continued)

*Primary Examiner* — Brian D Walck
*Assistant Examiner* — Danielle Carda
(74) *Attorney, Agent, or Firm* — Kilpatrick Townsend & Stockton LLP

(57) ABSTRACT

Provided are new high strength 6xxx aluminum alloys and methods of making aluminum sheets thereof. These aluminum sheets may be used to fabricate components which may replace steel in a variety of applications including the transportation industry. In some examples, the disclosed high strength 6xxx alloys can replace high strength steels with aluminum. In one example, steels having a yield strength below 340 MPa may be replaced with the disclosed 6xxx aluminum alloys without the need for major design modifications.

10 Claims, 20 Drawing Sheets

Related U.S. Application Data

(60) Provisional application No. 62/269,180, filed on Dec. 18, 2015.

(51) Int. Cl.

| | |
|---|---|
| ***C22C 21/06*** | (2006.01) |
| ***C22C 21/08*** | (2006.01) |
| ***C22C 21/14*** | (2006.01) |
| ***C22C 21/16*** | (2006.01) |
| ***C22F 1/043*** | (2006.01) |
| ***C22F 1/047*** | (2006.01) |
| ***C22F 1/057*** | (2006.01) |

(52) U.S. Cl.
CPC ..... *C22C 21/14* (2013.01); *C22C 21/16* (2013.01); *C22F 1/043* (2013.01); *C22F 1/047* (2013.01); *C22F 1/057* (2013.01)

(58) Field of Classification Search
CPC ..... C22F 1/053; C22C 21/00; C22C 21/02; C22C 21/04; C22C 21/06; C22C 21/08; C22C 21/14; C22C 21/16; C22C 21/10; C22C 21/18; C21D 9/46
USPC ..... 148/551
See application file for complete search history.

(56) References Cited

U.S. PATENT DOCUMENTS

| | | | | |
|---|---|---|---|---|
| 4,614,552 | A | 9/1986 | Fortin et al. | |
| 4,637,842 | A * | 1/1987 | Jeffrey | C22F 1/05 148/415 |
| 4,897,124 | A | 1/1990 | Matsuo et al. | |
| 5,503,690 | A | 4/1996 | Wade et al. | |
| 5,620,652 | A | 4/1997 | Tack et al. | |
| 5,662,750 | A | 9/1997 | Shen | |
| 5,690,758 | A | 11/1997 | Oh et al. | |
| 5,961,752 | A | 10/1999 | Bergsma | |
| 6,004,506 | A | 12/1999 | Chu et al. | |
| 6,120,623 | A | 9/2000 | Gupta et al. | |
| 6,231,809 | B1 | 5/2001 | Matsumoto et al. | |
| 6,280,543 | B1 | 8/2001 | Zonker et al. | |
| 6,423,164 | B1 | 7/2002 | Bryant et al. | |
| 6,537,392 | B2 | 3/2003 | Magnusen et al. | |
| 6,652,678 | B1 * | 11/2003 | Marshall | C22C 21/02 148/695 |
| 6,695,935 | B1 | 2/2004 | Haszler et al. | |
| 7,182,825 | B2 | 2/2007 | Unal et al. | |
| 8,728,256 | B2 | 5/2014 | Che et al. | |
| 8,758,529 | B2 | 6/2014 | Wang et al. | |
| 9,217,622 | B2 | 12/2015 | Mooy et al. | |
| 9,359,660 | B2 | 6/2016 | Kamat et al. | |
| 9,828,652 | B2 | 11/2017 | Kamat et al. | |
| 9,834,828 | B2 | 12/2017 | Doty | |
| 9,870,841 | B2 | 1/2018 | Yoshida et al. | |
| 9,890,443 | B2 | 2/2018 | Lin et al. | |
| 10,096,394 | B2 | 10/2018 | Sekiya et al. | |
| 10,533,243 | B2 | 1/2020 | Newman et al. | |
| 10,550,455 | B2 | 2/2020 | Hosch et al. | |
| 2002/0005232 | A1 | 1/2002 | Matsuda et al. | |
| 2002/0014290 | A1 | 2/2002 | Dif et al. | |
| 2002/0017344 | A1 | 2/2002 | Gupta et al. | |
| 2003/0029531 | A1 * | 2/2003 | Bull | C22F 1/05 420/534 |
| 2003/0143102 | A1 | 7/2003 | Matsuoka et al. | |
| 2004/0094249 | A1 | 5/2004 | Uchida et al. | |
| 2004/0177902 | A1 | 9/2004 | Mergen et al. | |
| 2004/0187985 | A1 | 9/2004 | Matsumoto et al. | |
| 2005/0028894 | A1 | 2/2005 | Hoffmann et al. | |
| 2005/0288894 | A1 | 12/2005 | Vorenkamp et al. | |
| 2007/0209739 | A1 | 9/2007 | Zhao | |
| 2008/0145266 | A1 * | 6/2008 | Chen | C22C 21/00 420/532 |
| 2008/0175747 | A1 | 7/2008 | Kajihara et al. | |
| 2009/0242088 | A1 | 10/2009 | Takaki et al. | |
| 2010/0059151 | A1 | 3/2010 | Iwamura et al. | |
| 2011/0017370 | A1 * | 1/2011 | Takaki | C22C 21/08 148/692 |
| 2011/0250469 | A1 | 10/2011 | De Smet et al. | |
| 2012/0055590 | A1 | 3/2012 | Kamat et al. | |
| 2012/0055591 | A1 | 3/2012 | Kamat et al. | |
| 2013/0334091 | A1 | 12/2013 | Sawtell et al. | |
| 2014/0003993 | A1 | 1/2014 | Matsumoto et al. | |
| 2014/0083575 | A1 | 3/2014 | Minoda et al. | |
| 2014/0248177 | A1 | 9/2014 | Kamat et al. | |
| 2014/0290809 | A1 | 10/2014 | Hori et al. | |
| 2014/0366997 | A1 * | 12/2014 | Kamat | C22C 21/08 148/688 |
| 2014/0366998 | A1 | 12/2014 | Kamat et al. | |
| 2014/0366999 | A1 | 12/2014 | Kamat et al. | |
| 2015/0007909 | A1 | 1/2015 | Matsumoto et al. | |
| 2015/0050520 | A1 | 2/2015 | Niikura et al. | |
| 2015/0316210 | A1 | 11/2015 | Nakai et al. | |
| 2015/0376741 | A1 | 12/2015 | Kobayashi et al. | |
| 2016/0047021 | A1 | 2/2016 | Nakamura et al. | |
| 2016/0047022 | A1 | 2/2016 | Nasserrafi et al. | |
| 2016/0222492 | A1 * | 8/2016 | Shishido | C22C 21/02 |
| 2017/0175240 | A1 | 6/2017 | Wen et al. | |
| 2018/0044755 | A1 | 2/2018 | Kamat et al. | |
| 2018/0117650 | A1 | 5/2018 | Felberbaum et al. | |

FOREIGN PATENT DOCUMENTS

| | | | | |
|---|---|---|---|---|
| CN | 1217030 | A | 5/1999 | |
| CN | 101880801 | | 11/2010 | |
| CN | 101935785 | | 1/2011 | |
| CN | 104039996 | A | 9/2014 | |
| CN | 104284745 | | 1/2015 | |
| CN | 105026588 | A | 11/2015 | |
| EP | 1170118 | | 1/2002 | |
| EP | 1195449 | | 4/2002 | |
| EP | 0990058 | | 11/2003 | |
| EP | 1633900 | | 6/2009 | |
| EP | 2075348 | | 7/2009 | |
| EP | 3124633 | | 2/2017 | |
| FR | 2922222 | | 4/2009 | |
| GB | 650905 | | 3/1951 | |
| JP | H0543974 | | 2/1993 | |
| JP | 0570908 | A | 3/1993 | |
| JP | 05112840 | | 5/1993 | |
| JP | H06136478 | | 5/1994 | |
| JP | 06240424 | | 8/1994 | |
| JP | 0860285 | | 3/1996 | |
| JP | 0931616 | | 2/1997 | |
| JP | 09209068 | | 8/1997 | |
| JP | 10130768 | | 5/1998 | |
| JP | 2000129382 | | 5/2000 | |
| JP | 2000160310 | | 6/2000 | |
| JP | 2004043907 | | 2/2004 | |
| JP | 2005042187 | | 2/2005 | |
| JP | 2005043974 | | 2/2005 | |
| JP | 2005240113 | | 9/2005 | |
| JP | 2006009140 | | 1/2006 | |
| JP | 2007009262 | | 1/2007 | |
| JP | 2007009262 | A * | 1/2007 | |
| JP | 2008045192 | | 2/2008 | |
| JP | 2013542320 | | 11/2013 | |
| JP | 2015034330 | | 2/2015 | |
| JP | 2015528856 | | 10/2015 | |
| KR | 1020130103423 | | 9/2013 | |
| RU | 2218437 | | 12/2003 | |
| RU | 2221891 | | 1/2004 | |
| RU | 71175 | | 2/2008 | |
| RU | 2326181 | | 6/2008 | |
| RU | 2327758 | | 6/2008 | |
| RU | 2394113 | | 7/2010 | |
| RU | 2537052 | | 12/2014 | |
| RU | 2691081 | | 6/2019 | |
| WO | 9527091 | | 10/1995 | |
| WO | 9801591 | | 1/1998 | |
| WO | 9859086 | | 12/1998 | |
| WO | WO-9859086 | A1 * | 12/1998 | C22F 1/05 |
| WO | 0003052 | | 1/2000 | |

(56) References Cited

FOREIGN PATENT DOCUMENTS

| | | | |
|---|---|---|---|
| WO | 0015859 | | 3/2000 |
| WO | 0070115 | | 11/2000 |
| WO | 0192591 | | 12/2001 |
| WO | 02099151 | | 12/2002 |
| WO | 2004001086 | | 12/2003 |
| WO | 2005049878 | | 6/2005 |
| WO | 2005100623 | | 10/2005 |
| WO | 2007076980 | | 7/2007 |
| WO | 2008123355 | | 10/2008 |
| WO | 2008152919 | | 12/2008 |
| WO | 2009036953 | A1 | 3/2009 |
| WO | 2009059826 | | 5/2009 |
| WO | 2009093559 | | 7/2009 |
| WO | 2009119724 | | 10/2009 |
| WO | 2009123011 | | 10/2009 |
| WO | 2010029572 | | 3/2010 |
| WO | 2010119070 | | 10/2010 |
| WO | 2012033954 | | 3/2012 |
| WO | 2012070803 | | 5/2012 |
| WO | 2012169317 | | 12/2012 |
| WO | 2013118734 | | 8/2013 |
| WO | 2013133978 | | 9/2013 |
| WO | 2014046010 | | 3/2014 |
| WO | 2014126073 | | 8/2014 |
| WO | 2014168147 | | 10/2014 |
| WO | 2015030598 | | 3/2015 |
| WO | 2015034024 | | 3/2015 |
| WO | 2015098484 | | 7/2015 |
| WO | 2015109893 | | 7/2015 |
| WO | 2015127805 | | 9/2015 |
| WO | 2015133004 | | 9/2015 |
| WO | 2015144302 | | 10/2015 |
| WO | 2015146654 | | 10/2015 |
| WO | 2015151886 | | 10/2015 |
| WO | 2015151907 | | 10/2015 |
| WO | 2016069695 | | 5/2016 |
| WO | 2018080710 | | 5/2018 |

OTHER PUBLICATIONS

Indian Application No. 201817020974, First Examination Report, mailed Apr. 8, 2021, 5 pages.
Korean Application No. 10-2018-7020075, Notice of Decision to Grant, mailed Feb. 22, 2021, 2 pages.
Canadian Application No. 3,006,318, Notice of Allowance, mailed on Jan. 4, 2021, 1 page.
European Application No. 16840353.3, Notice of Decision to Grant, mailed on Oct. 29, 2020, 2 pages.
Japanese Application No. 2018-528563, Notice of Decision to Grant, mailed on Oct. 27, 2020, 3 pages.
Canadian Application No. CA3,006,318, Office Action mailed on May 8, 2020, 3 pages.
Japanese Application No. JP2018-528563, Office Action mailed on Jun. 30, 2020, 9 pages. (4 pages of Original Document and 5 pages of English Translation).
"Heat Treatment of Aluminum Alloy Raw Materials", Auszug Norm AMS 2772F, Jul. 2011.
"International Alloy Designations and Chemical Composition Limits for Wrought Aluminum and Wrought Aluminum Alloys", The Aluminium Association, Registration Record Series Teal Sheets, Jan. 2015, 38 pages.
U.S. Appl. No. 16/534,520, First Action Interview Office Action Summary, Mailed on Jan. 7, 2022, 5 pages.
U.S. Appl. No. 16/534,520, First Action Interview Pilot Program Pre-Interview Communication, Mailed on Oct. 28, 2021, 6 pages.
Davis, "Aluminum and Aluminum Alloys", ASM Specialty Handbook, 1993, pp. 1-3.
Davydov et al., "TTP and TTT Diagrams for Quench Sensitivity of 6016 Alloy", Aluminum Alloys, vol. 2, 1998, 6 pages.
European Application No. 16840353.3, Notice of Opposition, Aug. 27, 2021, 23 pages.
European Application No. 16840353.3, Notice of Opposition, Sep. 8, 2021, 25 pages.
European Application No. 16840353.3, Notice of Opposition, Aug. 30, 2021, 33 pages.
Graf et al., "The Influence of Strain-Path Changes on Forming Limit Diagrams of Al 6111 T4", International Journal of Mechanical Sciences, vol. 36, No. 10, 1994, pp. 897-910.
Japanese Application No. 2018-528563, Office Action, mailed Oct. 6, 2021, 35 pages.
Kim et al., "Effects of Cu Addition on Behavior of Nanoclusters during Multi-Step Aging in Al—Mg—Si Alloys", Materials Transactions, vol. 52, No. 5, 2011, pp. 906-913.
Mukhopadhyay, "Alloy Designation, Processing, and Use of AA6XXX Series Aluminium Alloys", ISRN Metallurgy, vol. 12, Article ID 165082, Feb. 2012, pp. 1-15.
Prillhofer et al., "Characterization of the Artificial Aging Behavior and Formability of a High Strength EN AW-6016 at Different Heat Treatment Conditions Used for Automotive Applications", Sep. 2012.
"Aluminium Et Alliages D'Aluminium", NF EN 12258-1, Jul. 2012, 181 pages.
U.S. Appl. No. 62/269,385, filed Dec. 18, 2015, 72 pages.
Barrand et al., "L'Aluminium—Tome 1", Edition Eyrolles, 1964, pp. 612-615, 620-621.
Chinese Application No. 202110542886.2, Office Action, Mailed on Jan. 7, 2022, 30 pages.
Japanese Application No. 2018-528563, Office Action, Mailed on Feb. 2, 2022, 20 pages.
Stucky, "Traitements Thermiques Des Alliages D'Aluminium—Materiels Et Recommandations", Technique De L'Ingenieur M 1290v2, Jun. 10, 2011, 32 pages.
Japanese Application No. 2018-528563, Office Action, Mailed on Apr. 4, 2022, 50 pages.
Chinese Application No. 201680074145.3, Office Action, mailed Sep. 15, 2020, 22 pages.
Korean Application No. 10-2018-7020075, Office Action, mailed Sep. 7, 2020, 4 pages.
"International Alloy Designations and Chemical Composition Limits for Wrought Aluminum and Wrought Aluminum Alloys", The Aluminum Association, Inc., Registration Record Series, Teal Sheets, Feb. 1, 2009, 35 pages.
U.S. Appl. No. 15/381,776, "Final Office Action", Jun. 14, 2019, 6 pages.
U.S. Appl. No. 15/381,776, "Non-Final Office Action", Feb. 5, 2019, 8 pages.
U.S. Appl. No. 15/381,776, "Notice of Allowance", Sep. 26, 2019, 8 pages.
U.S. Appl. No. 15/381,776, "Restriction Requirement", Dec. 17, 2018, 5 pages.
Australian Application No. 2016369546, "First Examination Report", Mar. 22, 2019, 3 pages.
Australian Application No. AU2016369546, "Notice of Acceptance", Jun. 4, 2019, 3 pages.
Brazilian Application No. 112017021504-7, "Office Action", Mar. 31, 2020, 5 pages.
Brazilian Application No. BR112018010166-4, "Office Action", Mar. 31, 2020, 5 pages.
Canadian Application No. 3,006,318, "Office Action", Jul. 25, 2019, 4 pages.
Chinese Application No. 201680074145.3, "Office Action", Feb. 3, 2020, 10 pages.
Chinese Application No. 201680074145.3, "Office Action", Aug. 5, 2019, 27 pages.
Daiming, "Metal Material Science", Southwest Jiaotong University Press, Jun. 30, 2014, 5 pages.
European Application No. 16840352.5, "Office Action", Feb. 24, 2020, 4 pages.
European Application No. 16840353.3, "Office Action", Oct. 14, 2019, 4 pages.
Jiarong, "Q&A on Production Technology of Aluminum Alloy Casting", Metallurgical Industry Press, Jan. 31, 2008, 6 pages.
Japanese Application No. 2017-551195, "Notice of Decision to Grant", Feb. 4, 2020, 3 pages.

(56) References Cited

OTHER PUBLICATIONS

Japanese Application No. 2018528563, "Office Action", Apr. 23, 2019, 14 pages.
Japanese Application No. 2018-528563, "Office Action", Jan. 7, 2020, 3 pages.
Korean Application No. 10-2018-7020075, "Office Action", Feb. 12, 2020, 19 pages.
Korean Application No. 10-2019-7038949, "Notice of Decision to Grant", Jan. 15, 2020.
Niranjani et al., "Development of High Strength Al—Mg—Si AA6061 Alloy Through Cold Rolling and Ageing", Materials Science and Engineering A, vol. 515, Nos. 1-2, Jul. 25, 2009, pp. 169-174.
International Application No. PCT/US2016/067209, "International Preliminary Report on Patentability", Jun. 28, 2018, 9 pages.
International Application No. PCT/US2016/067209, "International Search Report and Written Opinion", May 9, 2017, 15 pages.
PCT/US2019/032246, "International Search Report and Written Opinion", Aug. 8, 2019, 13 pages.
Russian Application No. 2018120738, "Notice of Decision to Grant", Mar. 28, 2019, 19 pages.
Russian Application No. 2018121947, "Notice of Decision to Grant", Feb. 19, 2020, 17 pages.
Wang et al., "Improving the Strength and Ductility of Al—Mg—Si—Cu Alloys by a Novel Thermo-Mechanical Treatment", Materials Science and Engineering: A, vol. 607, Jun. 23, 2014, pp. 313-317.
Yuanyuan, "New Materials, Science and Technology Metallic Material Volume", South China University of Technology Press, Sep. 30, 2012, 6 pages.
"Rolling Aluminum: From the Mine Through the Mill", The Aluminum Association, 3rd Edition, Dec. 2007, 8 pages.
U.S. Appl. No. 16/534,520, "Final Office Action", May 24, 2022, 14 pages.
U.S. Appl. No. 16/534,520, "Non-Final Office Action", Nov. 29, 2022, 9 pages.
Chinese Application No. 202110542886.2, "Office Action", Sep. 8, 2022, 14 pages.
Chinese Application No. 202110542886.2, "Office Action", Jun. 2, 2022, 25 pages.
European Application No. 16840353.3, "Summons to Attend Oral Proceedings", Sep. 22, 2022, 15 pages.
"English Translation of JP 0570908 A", Mar. 23, 1993, 11 pages.
"English Translation of JP 0931616 A", Feb. 4, 1997, 4 pages.
U.S. Appl. No. 62/269,180, High Strength 6XXX Alloys and Methods of Manufacture, filed Dec. 18, 2015, 52 pages.
U.S. Appl. No. 62/413,591, Decoupled Continuous Casting and Rolling Line, filed Oct. 27, 2016, 83 pages.
U.S. Appl. No. 62/413,740, High Strength 6XXX Series Aluminum Alloy and Methods of Making the Same, filed Oct. 27, 2016, 40 pages.
U.S. Appl. No. 62/505,944, Decoupled Continuous Casting and Rolling Line, filed May 14, 2017, 125 pages.
U.S. Appl. No. 62/529,028, Systems and Methods for Making Aluminum Alloy Plates, filed Jul. 6, 2017, 35 pages.
U.S. Appl. No. 16/534,520, "Final Office Action", Apr. 12, 2023, 9 pages.
Chinese Application No. 201680074145.3, "Office Action", Apr. 6, 2023, 22 pages.
Li, "Modem Material Science and Engineering Dictionary", Shandong Science and Technology Press, Aug. 2001.
"English Translation of CN 101880801 A", Nov. 10, 2010, 9 pages.
"English Translation of CN 101935785 A", Jan. 5, 2011, 11 pages.
"English Translation of JP 05112840 A", May 7, 1993, 15 pages.
"English Translation of JP 06240424 A", Aug. 30, 1994, 5 pages.
"English Translation of JP 09209068 A", Aug. 12, 1997, 7 pages.
"English Translation of JP 10130768 A", May 19, 1998, 10 pages.
"English Translation of JP 2000160310 A", Jun. 13, 2000, 15 pages.
"Excerpt Norm AMS 2772", Jul. 2011, 3 pages.
"Original Application Documents", Jun. 22, 2017, 58 pages.
"Treatment Handbook", Electric Group, Shanghai Scientific & Technical Publishers, Mar. 2003, pp. 376-377.
U.S. Appl. No. 16/534,520, "Notice of Allowance", Aug. 22, 2023, 8 pages.
European Application No. 16840353.3, "EPO Written Decision to Reject/Revoke", Jul. 5, 2023, 26 pages.
Mexican Application No. MX/A/2018/006956, "Office Action", Oct. 25, 2023, 4 pages.

* cited by examiner

| | AA6014 | AA6451 | AA6451 + 0.3% Cu | 0657 | AA6111 | HIGH STRENGTH 6XXX |
|---|---|---|---|---|---|---|
| BASELINE T4 Rp0.2 (MPa) | 102 | 162 | 162 | 182 | 127 | 209 |
| BASELINE T6 Rp0.2 (MPa) | 242 | 288 | 299 | | | 333 |
| Rp0.2 (MPa) | ~240-320 | ~302-365 | ~340-410 | ~360-420 | ~365-415 | ~400-455 |
| A80 (%) | ~7.6-14.4 | ~9.0-14.3 | ~6.5-14.0 | ~6.5-12.0 | ~8.0-12.8 | ~6.0-10.5 |

STRENGTHS (Rp0.2 (MPa)) AND ELONGATION (A80(%)) OF VARIOUS ALLOYS

FIG. 15

| Rp 0.2 (MPa) | AA6451 WITH 0.3% Cu | AA6451 WITH 0.1% Cu |
|---|---|---|
| T4 | 165 | 150 |
| +30% CR | 325 | 300 |
| +140°C FOR 10 HRS | 350 | 320 |

FIG. 16

| A80 (%) | AA6451 WITH 0.3% Cu | AA6451 WITH 0.1% Cu |
|---|---|---|
| T4 | 26 | 25 |
| +30% CR | 7 | 7 |
| +140°C FOR 10 HRS | 12 | 12 |

FIG. 17

HIGH STRENGTH 6XXX ALUMINUM ALLOYS AND METHODS OF MAKING THE SAME

CROSS REFERENCE TO RELATED APPLICATIONS

The present application is a divisional of U.S. patent application Ser. No. 15/381,776, filed Dec. 16, 2016, which claims priority to and filing benefit of U.S. provisional patent application Ser. No. 62/269,180 filed on Dec. 18, 2015. These applications are incorporated herein by reference in their entireties.

FIELD OF THE INVENTION

The invention provides new high strength 6xxx aluminum alloys and methods of manufacturing these alloys. These alloys display improved mechanical properties.

BACKGROUND

Steel components in vehicles increase vehicle weight and decrease fuel efficiency. Replacing steel components with high strength aluminum components is desirable as this would decrease vehicle weight and increase fuel efficiency. New 6xxx aluminum alloys with high yield strength and low elongation and methods of making these alloys are needed.

SUMMARY OF THE INVENTION

Covered embodiments of the invention are defined by the claims, not this summary. This summary is a high-level overview of various aspects of the invention and introduces some of the concepts that are further described in the figures and in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

Disclosed are new, high strength 6xxx aluminum alloys compositions. Elemental composition of 6xxx aluminum alloys described herein can include 0.001-0.25 wt. % Cr, 0.4-2.0 wt. % Cu, 0.10-0.30 wt. % Fe, 0.5-2.0 wt. % Mg, 0.005-0.40 wt. % Mn, 0.5-1.5 wt. % Si, up to 0.15 wt. % Ti, up to 4.0 wt. % Zn, up to 0.2 wt. % Zr, up to 0.2 wt. % Sc, up to 0.25 wt. Sn, up to 0.1 wt. % Ni, up to 0.15 wt. % total impurities, and the remaining wt. % Al. In some non-limiting examples, a 6xxx aluminum alloy described herein can include 0.03 wt. % Cr, 0.8 wt. % Cu, 0.15 wt. % Fe, 1.0 wt. % Mg, 0.2 wt. % Mn, 1.2 wt. % Si, 0.04 wt. % Ti, 0.01 wt. % Zn, and up to 0.15 wt. % impurities, remaining wt. % Al. In some further non-limiting examples, a 6xxx aluminum alloy described herein can include 0.03 wt. % Cr, 0.4 wt. % Cu, 0.15 wt. % Fe, 1.3 wt. % Mg, 0.2 wt. % Mn, 1.3 wt. % Si, 0.04 wt. % Ti, 0.01 wt. % Zn, and up to 0.15 wt. % impurities, remaining wt. % Al. In still further non-limiting examples, a 6xxx aluminum alloy described herein can include 0.1 wt. % Cr, 0.4 wt. % Cu, 0.15 wt. % Fe, 1.3 wt. % Mg, 0.2 wt. % Mn, 1.3 wt. % Si, 0.04 wt. % Ti, 0.01 wt. % Zn, and up to 0.15 wt. % impurities, remaining wt. % Al.

Also disclosed are methods of manufacturing these new high strength 6xxx alloys compositions. A method of making an aluminum alloy sheet can include casting a 6xxx aluminum alloy, rapidly heating the cast 6xxx aluminum alloy to a temperature between 510° C. and 590° C., maintaining the cast 6xxx aluminum alloy at the temperature between 510° C. and 590° C. for 0.5 to 4 hours, decreasing the temperature to approximately 420° C. to 480° C., and hot rolling the cast 6xxx aluminum alloy into the aluminum alloy sheet. The rolled aluminum alloy sheet can have a thickness up to approximately 18 mm and a hot roll exit temperature between 330° C. and 390° C. The aluminum alloys sheet can be subjected to heat treating at a temperature between 510° C. and 540° C. for 0.5 to 1 hour and subsequent quenching to ambient temperature. The aluminum alloy sheet can optionally be cold rolled to a final gauge, wherein the cold rolling results in a thickness reduction of 10% to 45%. The aluminum alloy sheet can optionally be aged by maintaining the aluminum alloy sheet at 200° C. for 0.5 to 6 hours.

The 6xxx aluminum alloy sheet produced by the method described above can achieve a yield strength of at least 300 MPa and/or an elongation of at least 10%. The 6xxx aluminum alloy sheet can also exhibit a minimum r/t ratio of about 1.2 without cracking, where r is the radius of the tool (die) used and t is the thickness of the material.

In some examples, a method of making an aluminum alloy sheet can include continuously casting a 6xxx aluminum alloy, rapidly heating the continuously cast 6xxx aluminum alloy to a temperature of 510° C. to 590° C., maintaining the temperature of 510° C. to 590° C. for 0.5 to 4 hours, decreasing the temperature to 420° C. to 480° C., hot rolling the continuously cast 6xxx aluminum alloy to a thickness below 1 mm at a hot roll exit temperature of 330° C. to 390° C., heat treating the aluminum alloy sheet at a temperature of 510° C. to 540° C. for 0.5 to 1 hour, and quenching the aluminum alloy sheet to ambient temperature. The aluminum alloy sheet can further be subjected to cold rolling and aging by maintaining the aluminum alloy sheet at 200° C. for 0.5 to 6 hours. The aluminum alloy sheet can optionally be cold rolled to a final gauge, wherein the cold rolling results in a thickness reduction of 10% to 45%.

The 6xxx aluminum alloy sheet produced by the method described above can achieve a yield strength of at least 300 MPa and/or an elongation of at least 10%. The 6xxx aluminum alloy sheet can also exhibit a minimum r/t ratio of about 1.2 without cracking. These new high strength 6xxx alloys have many uses in the transportation industry and can replace steel components to produce lighter weight vehicles. Such vehicles include, without limitation, automobiles, vans, campers, mobile homes, trucks, body in white, cabs of trucks, trailers, buses, motorcycles, scooters, bicycles, boats, ships, shipping containers, trains, train engines, rail passenger cars, rail freight cars, planes, drones, and spacecraft.

The new high strength 6xxx alloys may be used to replace steel components, such as in a chassis or a component part of a chassis. These new high strength 6xxx alloys may also be used, without limitation, in vehicle parts, for example train parts, ship parts, truck parts, bus parts, aerospace parts, body in white of vehicles, and car parts.

The disclosed high strength 6xxx alloys can replace high strength steels with aluminum. In one example, steels having a yield strength below 340 MPa may be replaced with the disclosed 6xxx aluminum alloys without the need for major design modifications, except for adding stiffeners when required, where stiffeners refer to extra added metal plates or rods when required by design.

These new high strength 6xxx alloys may be used in other applications that require high strength without a major decrease in ductility (maintaining a total elongation of at least 8%). For example, these high strength 6xxx alloys can be used in electronics applications and in specialty products including, without limitation, battery plates, electronic components, and parts of electronic devices.

Other objects and advantages of the invention will be apparent from the following detailed description of non-limiting examples of the invention.

BRIEF DESCRIPTION OF THE FIGURES

FIG. 5A includes a length bar=50 nm, and FIG. 5B includes a length bar=20 nm.

In FIG. 8 and in FIG. 9, the samples were run at a 2 mm gauge.

Cr-0.01%; and Zn-0.01%)). The figure shows that increasing cold work increased strength and decreased elongation. The range of elongation values for 30% CR was from about 6% to about 12% while the corresponding strength levels ranged from about 370 MPa to about 425 MPa. The range of elongation values for 50% CR was from about 3% to about 10% while the corresponding strength levels ranged from about 390 MPa to about 450 MPa. 50% CR resulted in higher strength but lower elongation than 30% CR. The data demonstrate that a change in CR can be used to obtain a compromise between strength and elongation.

Figure 13:
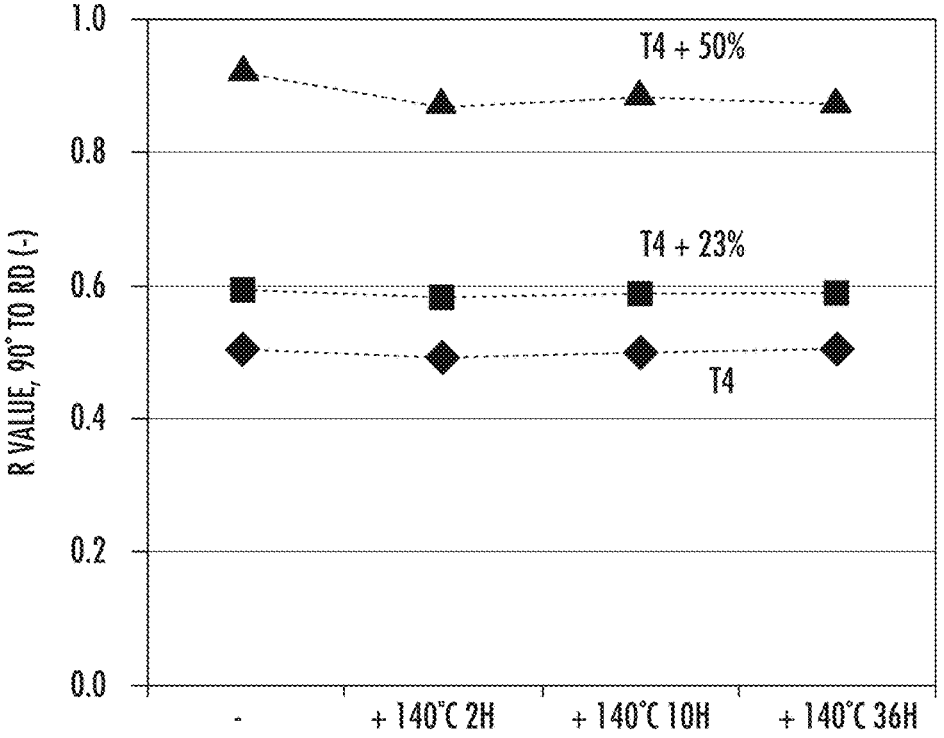

FIG. 13 is a chart showing the effects of CR on change in surface texture (r-value) at 90° relative to the rolling direction. The alloy tested was AA6451 plus 0.3% Cu in the T4 condition. Triangles represent the T4 condition plus 50% CR, squares represent T4 condition plus 23% CR, diamonds indicate the T4 condition at 140° C. for 2, 10 or 36 hours of artificial aging. The data demonstrate that increasing cold work increases the r-value 90° to the rolling direction. The data also demonstrate that aging after cold reduction does not significantly change the r-value.

Figure 14:
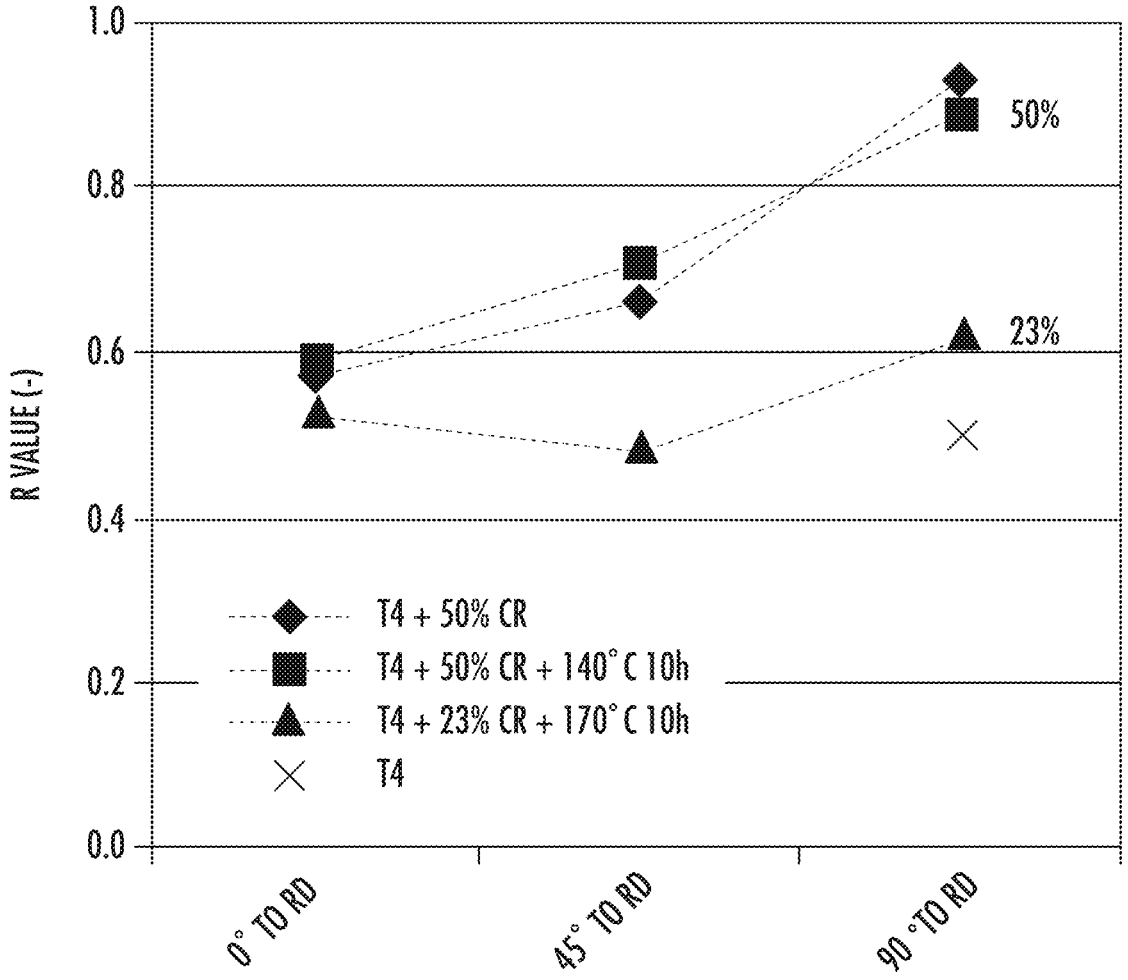

FIG. 14 is a chart showing the effects of CR on change in surface texture (r-value). The alloy tested was AA6451 plus 0.3% Cu in the T4 condition. X indicates the T4 condition, triangles represent the T4 condition plus 23% CR plus 170° C. for 10 hours of artificial aging, squares represent the T4 condition plus 50% CR plus 140° C. for 10 hours of artificial aging, diamonds indicate the T4 condition plus 50% CR. The data demonstrate that increasing cold work increases the r-value 90° to the rolling direction. The data also demonstrate that aging after cold reduction does not significantly change the r-value.

FIG. 15 is a table of strengths and elongations of various alloys following 20 to 50% CR and aging at 120° C. to 180° C. Strength measurements were obtained 90° to the rolling direction. Alloys tested were AA6014, AA6451, AA6451 plus 0.3% Cu, Alloy 0657 (an alloy having the composition of Si-1.1%; Fe-0.24%; Cu-0.3%; Mn-0.2%; Mg-0.7%; Cr-0.01%; Zn-0.02%; and Ti-0.02%), AA6111, Alloy 8931 (high strength 6xxx clad/core alloy composition (Core: Si-1.25%; Fe-0.2%; Cu-1.25%; Mn-0.25%; Mg-1.25%; Cr-0.04%; Zn-0.02%; and Ti-0.03%; Clad: Si-0.9%; Fe-0.16%; Cu-0.05%; Mn-0.06%; Mg-0.75%; Cr-0.01%; and Zn-0.01%)).

FIG. 16 is a table showing the effect of 30% CR followed by aging at 140° C. for 10 hours on yield strength (Rp0.2 (MPa)) of AA6451 alloy with 0.3% Cu and AA6451 alloy with 0.1% Cu. The results demonstrate that yield strength increases with 30% CR and aging at 140° C. for 10 hours for the alloy containing 0.3% Cu. There is also increase for the alloy containing 0.1% Cu, but it is not as profound as the alloy with 0.3% Cu.

FIG. 17 is a table showing the effect of 30% CR followed by aging at 140° C. for 10 hours on elongation (A80(%)) of AA6451 alloy with 0.3% Cu and AA6451 alloy with 0.1% Cu The results demonstrate that CR and aging have similar effects on elongation of alloys containing 0.3% Cu and 0.1% Cu.

Figure 18:
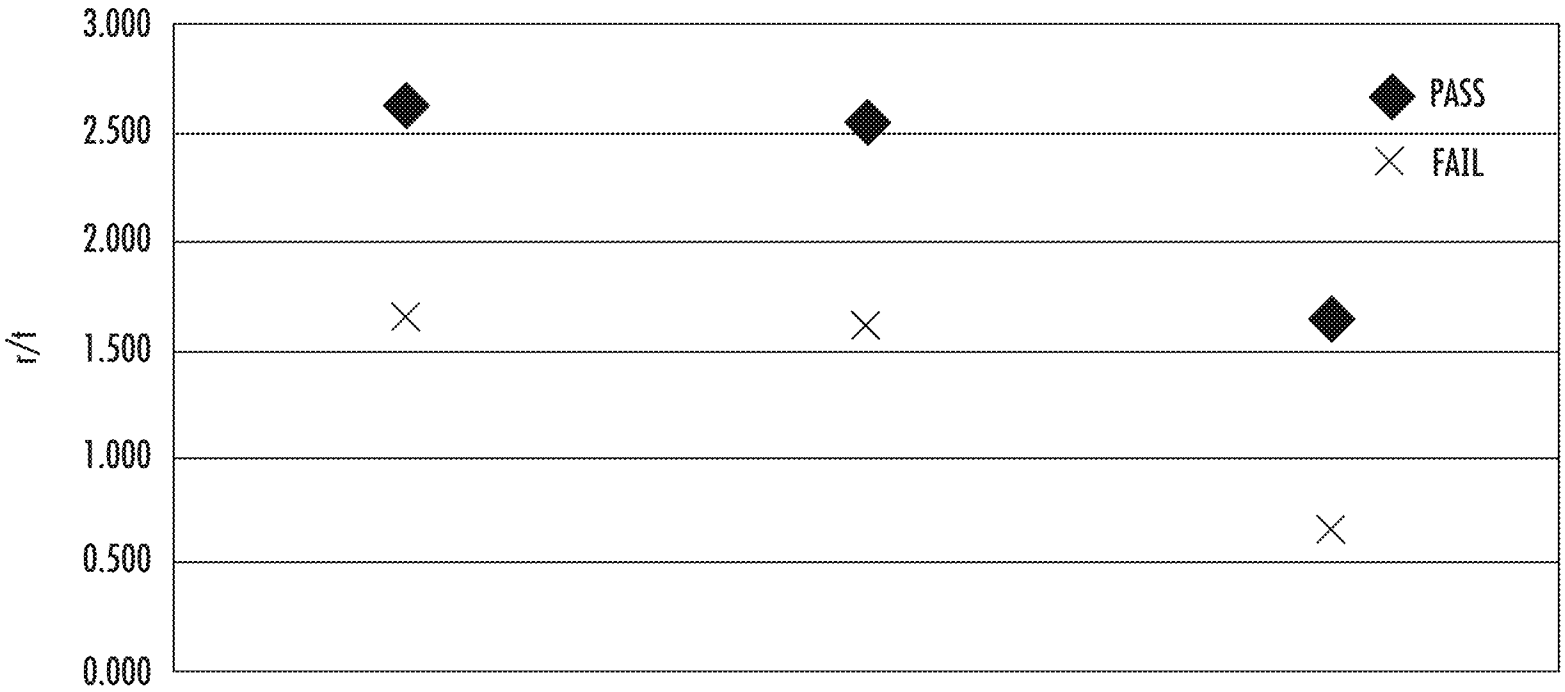

FIG. 18 is a chart showing bendability results (r/t y-axis) of Embodiment 1 (left), Embodiment 2-2 (middle) and typical AA6061 (right) each at 3 mm thickness in the T8 condition. Diamond=Pass, X=Fail.

Figure 19:
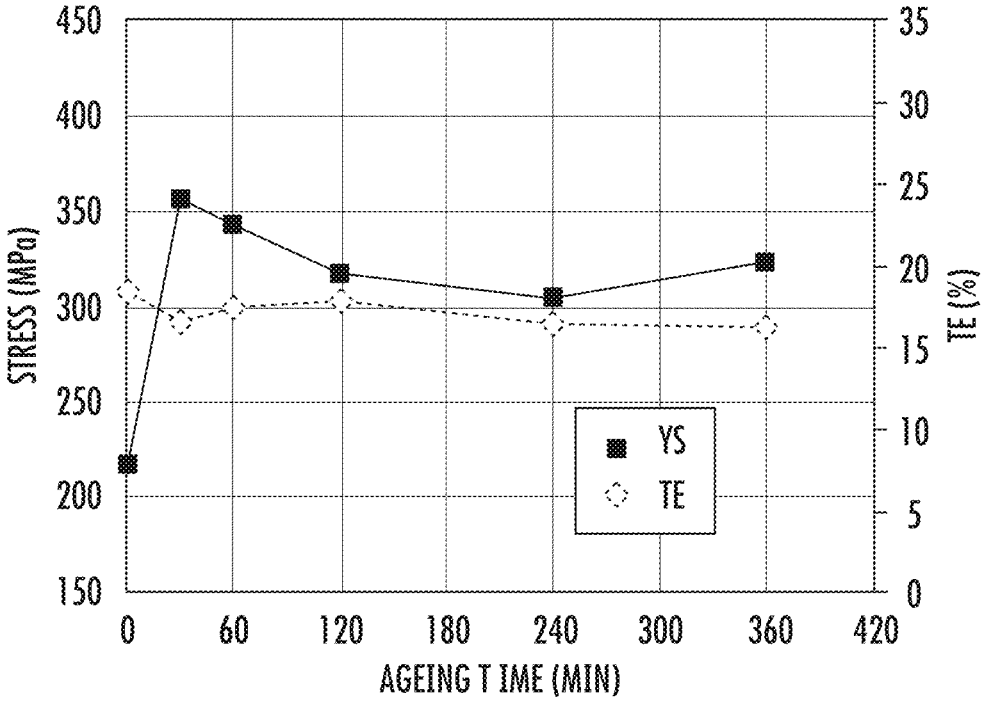

FIG. 19 is a schematic representation of Embodiment 1 (panel) subjected to 20% CR showing yield strength (squares) in MPa (left y-axis) and percent elongation (diamonds) in % TE on the right y-axis as a function of aging time (x-axis in minutes (min)).

Figure 20A:
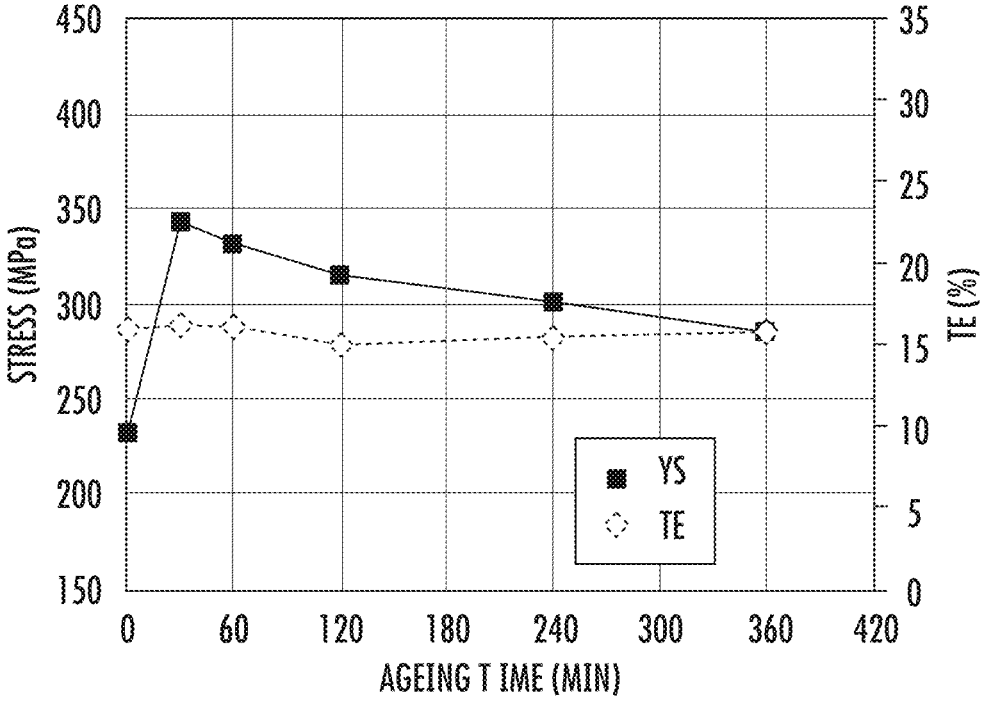
Figure 20B:
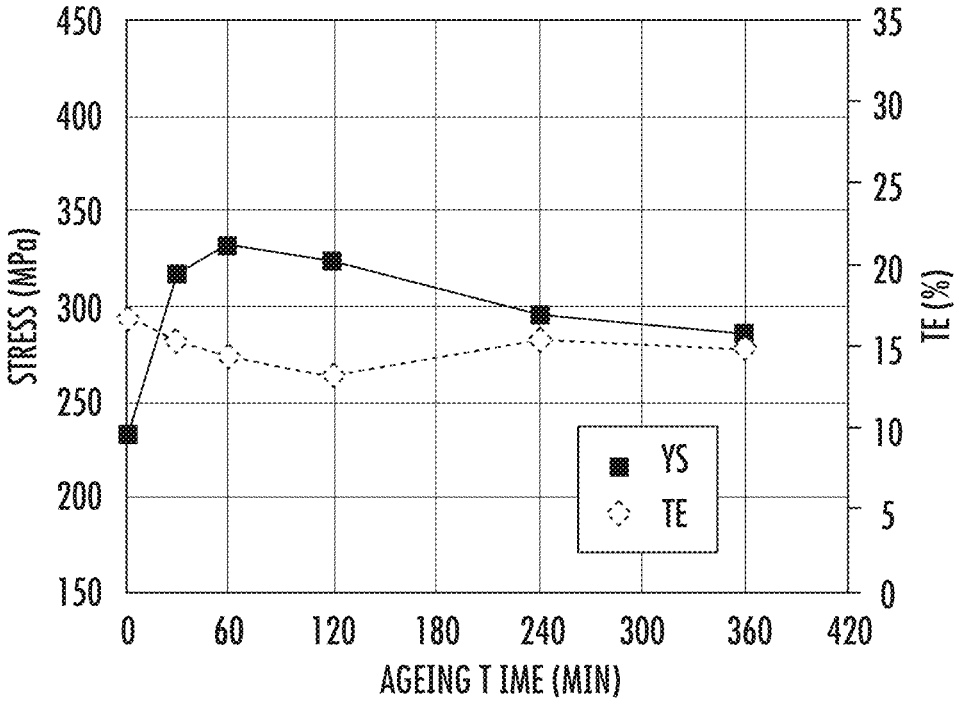

FIG. 20A is a chart showing Embodiment 2 and FIG. 20B is a chart showing Embodiment 2-2 subjected to 20% CR showing yield strength (squares) in MPa (left y-axis) and percent elongation (diamonds) in % TE on the right y-axis as a function of aging time (x-axis in minutes (min)).

Figure 21:
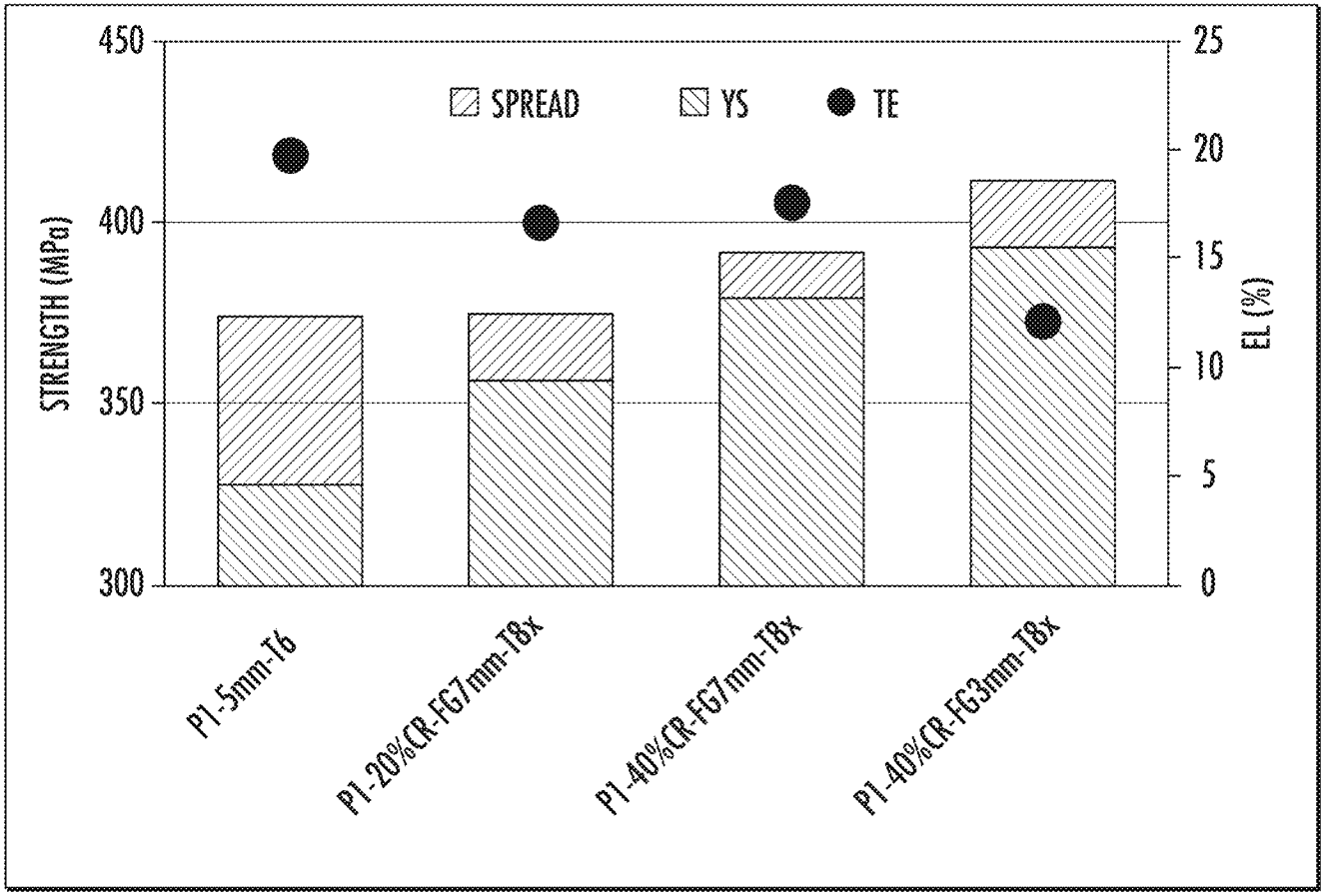

FIG. 21 is a bar chart showing yield strength (left y-axis) (YS in MPa, lower part of each histogram bar) and ultimate tensile strength (UTS in MPa, upper part of each histogram bar) and total % elongation as a filled circle (right y-axis) (EL %) of Embodiment 1. From left to right the histogram bars represent a) Embodiment 1 in T6 temper, 5 mm sheet; b) Embodiment 1 with 20% CW in T8x temper, 7 mm sheet; c) Embodiment 1 with 40% CW in T8x temper, 7 mm sheet; and d) Embodiment 1 with 40% CW in T8x temper, 3 mm sheet.

Figure 22:
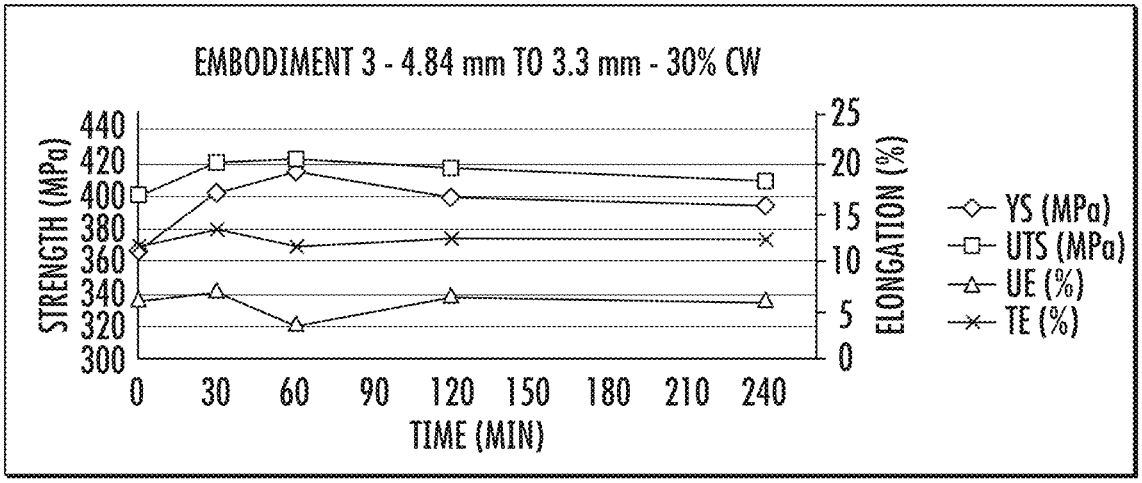

FIG. 22 is chart showing an aging curve following 30% CW. The left y-axis indicates strength in MPa, aging time (in hours) at 200° C. is indicated on the x-axis and elongation percent is shown on the right y-axis. These data were obtained using aluminum alloy Embodiment 3 with 30% CW. YS=yield strength, UTS=tensile strength, UE=uniform elongation (elongation at highest UTS), and TE=total elongation. This table shows that after 4 hours, the strength decreases or stays constant and the elongation decreases or stays constant.

Figure 23:
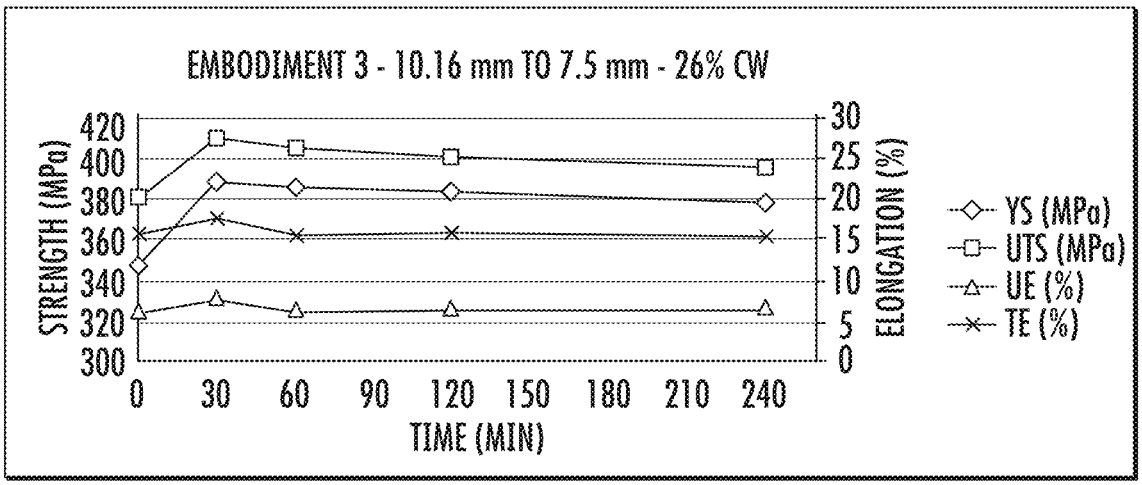

FIG. 23 is chart showing an aging curve following 26% CW. The left y-axis indicates strength in MPa, aging time (in hours) at 200° C. is indicated on the x-axis and elongation percent is shown on the right y-axis. These data were obtained using aluminum alloy Embodiment 3 with 26% CW. This table shows that after 4 hours, the strength decreases or stays constant and the elongation decreases or stays constant.

Figure 24:
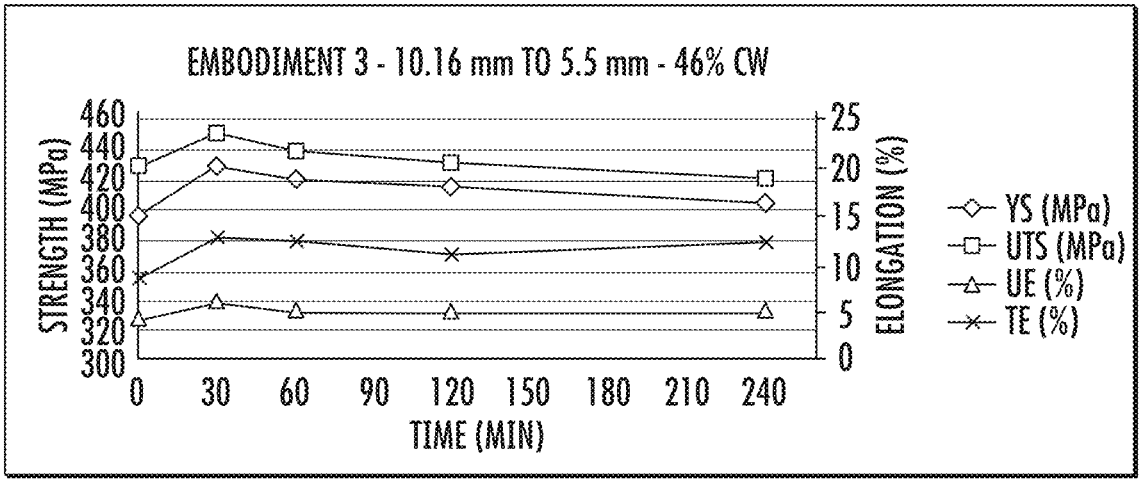

FIG. 24 is chart showing an aging curve following 46% CW. The left y-axis indicates strength in MPa, aging time (in hours) at 200° C. is indicated on the x-axis and elongation percent is shown on the right y-axis. These data were obtained using aluminum alloy Embodiment 3 with 46% CW. This table shows that after 4 hours, the strength decreases or stays constant and the elongation increases or stays constant.

Figure 25:
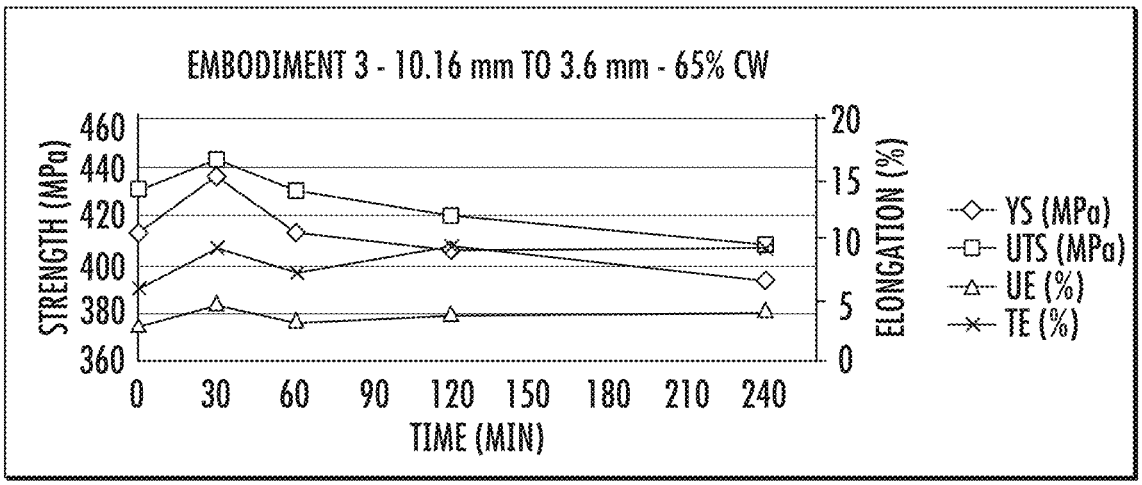

FIG. 25 is chart showing an aging curve following 65% CW. The left y-axis indicates strength in MPa, aging time (in hours) at 200° C. is indicated on the x-axis and elongation percent is shown on the right y-axis. These data were obtained using aluminum alloy Embodiment 3 with 65% CW. This table shows that after 4 hours, the strength decreases or stays constant and the elongation increases or stays constant.

Figure 26:
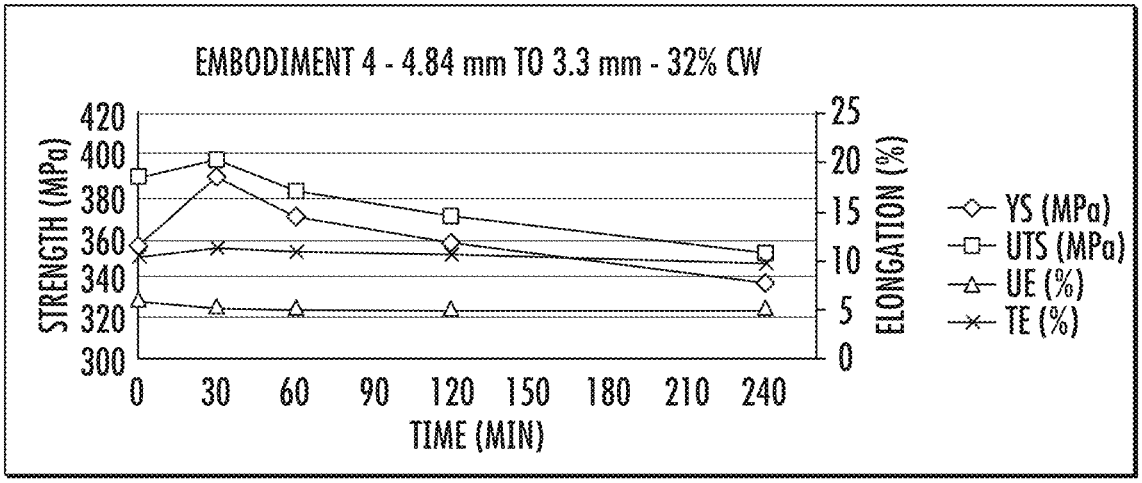

FIG. 26 is chart showing an aging curve following 32% CW. The left y-axis indicates strength in MPa, aging time (in hours) at 200° C. is indicated on the x-axis and elongation percent is shown on the right y-axis. These data were obtained using aluminum alloy Embodiment 4 with 32% CW. This table shows that after 4 hours, the strength decreases or stays constant and the elongation stays constant.

Figure 27:
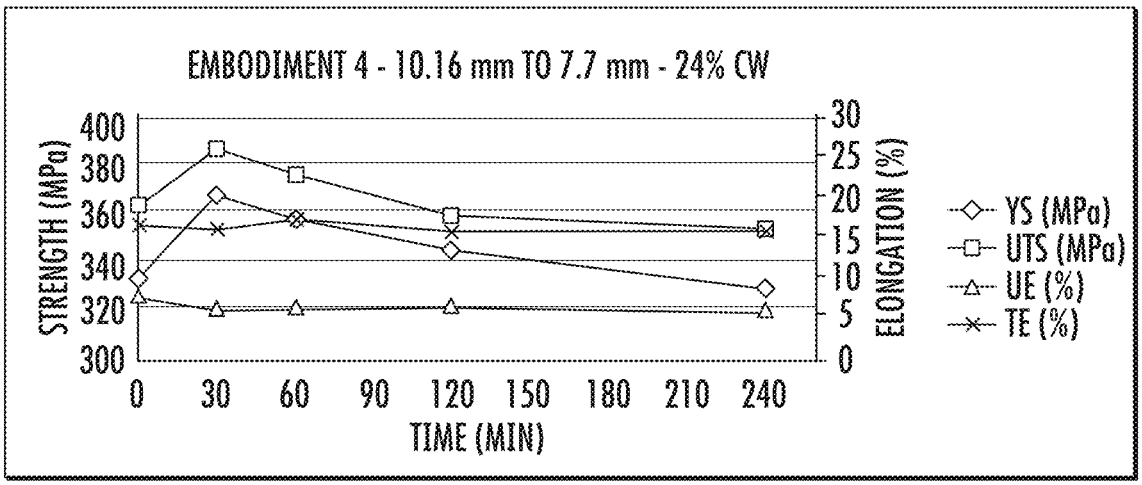

FIG. 27 is chart showing an aging curve following 24% CW. The left y-axis indicates strength in MPa, aging time (in hours) at 200° C. is indicated on the x-axis and elongation percent is shown on the right y-axis. These data were obtained using aluminum alloy Embodiment 4 with 24% CW. This table shows that after 4 hours, the strength decreases or stays constant and the elongation stays constant.

Figure 28:
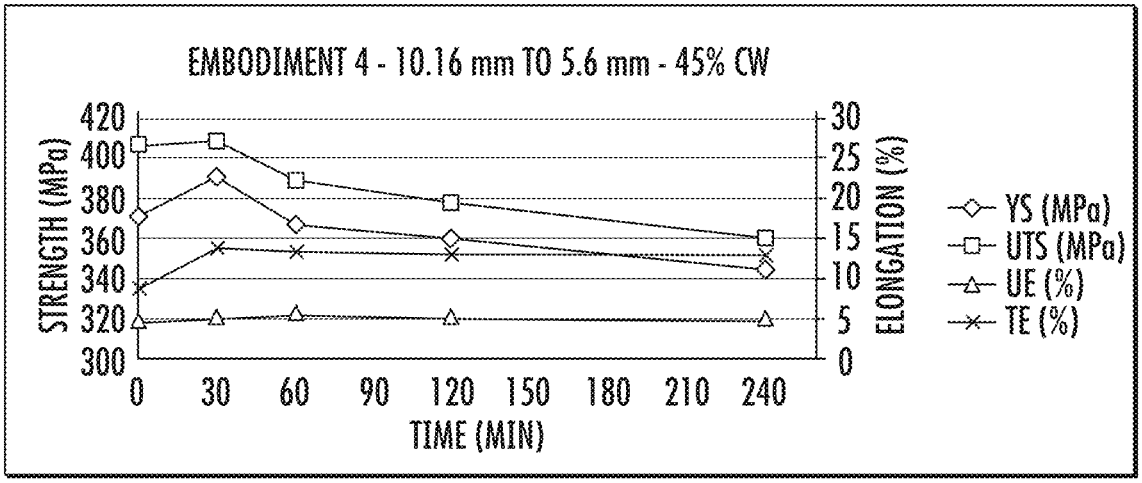

FIG. 28 is chart showing an aging curve following 45% CW. The left y-axis indicates strength in MPa, aging time (in hours) at 200° C. is indicated on the x-axis and elongation percent is shown on the right y-axis. These data were obtained using aluminum alloy Embodiment 4 with 45% CW. This table shows that after 4 hours, the strength decreases or stays constant and the elongation stays constant.

Figure 29:
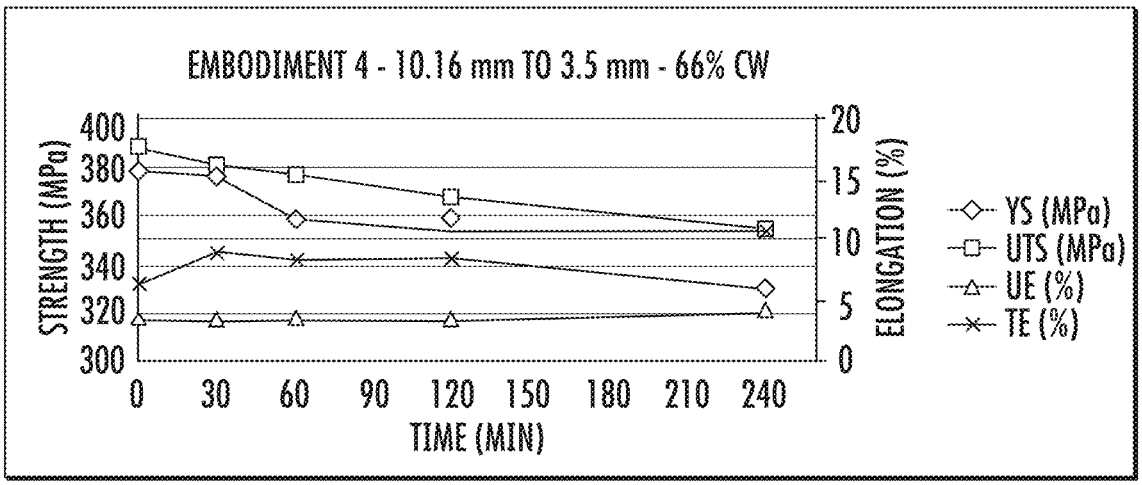

FIG. 29 is chart showing an aging curve following 66% CW. The left y-axis indicates strength in MPa, aging time (in hours) at 200° C. is indicated on the x-axis and elongation percent is shown on the right y-axis. These data were obtained using aluminum alloy Embodiment 4 with 66% CW. This table shows that after 4 hours, the strength decreases or stays constant and the elongation increases or stays constant.

DETAILED DESCRIPTION OF THE INVENTION

Definitions and Descriptions

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

Elements are expressed in weight percent (wt. %) throughout this application. The sum of impurities in an alloy may not exceed 0.15 wt. %. The remainder in each alloy is aluminum.

The term T4 temper and the like means an aluminum alloy body that has been solutionized and then naturally aged to a substantially stable condition. The T4 temper applies to bodies that are not cold worked after solutionizing, or in which the effect of cold work in flattening or straightening may not be recognized in mechanical property limits.

The term T6 temper and the like means an aluminum alloy body that has been solutionized and then artificially aged to a maximum strength condition (within 1 ksi of peak strength). The T6 temper applies to bodies that are not cold worked after solutionizing, or in which the effect of cold work in flattening or straightening may not be recognized in mechanical property limits.

The term T8 temper refers to an aluminum alloy that has been solution heat treated, cold worked, and then artificially aged.

The term F temper refers to an aluminum alloy that is as fabricated. Alloys:

In one example, the 6xxx aluminum alloys comprise 0.001-0.25 wt. % Cr, 0.4-2.0 wt. % Cu, 0.10-0.30 wt. % Fe, 0.5-2.0 wt. % Mg, 0.005-0.40 wt. % Mn, 0.5-1.5 wt. % Si, up to 0.15 wt. % Ti, up to 4.0 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In another example, the 6xxx aluminum alloys comprise 0.001-0.18 wt. % Cr, 0.5-2.0 wt. % Cu, 0.10-0.30 wt. % Fe, 0.6-1.5 wt. % Mg, 0.005-0.40 wt. % Mn, 0.5-1.35 wt. % Si, up to 0.15 wt. % Ti, up to 0.9 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In another example, the 6xxx aluminum alloys comprise 0.06-0.15 wt. % Cr, 0.9-1.5 wt. % Cu, 0.10-0.30 wt. % Fe, 0.7-1.2 wt. % Mg, 0.05-0.30 wt. % Mn, 0.7-1.1 wt. % Si, up to 0.15 wt. % Ti, up to 0.2 wt. % Zn, up to 0.2 wt. % Zr, up to 0.2 wt. % Sc, up to 0.25 wt. % Sn, up to 0.07 wt. % Ni, up to 0.15 wt. % impurities, remainder aluminum.

In another example, the 6xxx aluminum alloys comprise 0.06-0.15 wt. % Cr, 0.6-0.9 wt. % Cu, 0.10-0.30 wt. % Fe, 0.9-1.5 wt. % Mg, 0.05-0.30 wt. % Mn, 0.7-1.1 wt. % Si, up to 0.15 wt. % Ti, up to 0.2 wt. % Zn, up to 0.2 wt. % Zr, up to 0.2 wt. % Sc, up to 0.25 wt. % Sn, up to 0.07 wt. % Ni, up to 0.15 wt. % impurities, remainder aluminum.

In another example, the 6xxx aluminum alloys comprise 0.02-0.15 wt. % Cr, 0.4-1.0 wt. % Cu, 0.10-0.30 wt. % Fe, 0.8-2.0 wt. % Mg, 0.10-0.30 wt. % Mn, 0.8-1.4 wt. % Si, 0.005-0.15 wt. % Ti, 0.01-3.0 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In another example, the 6xxx aluminum alloys comprise 0.02-0.15 wt. % Cr, 0.4-1.0 wt. % Cu, 0.15-0.25 wt. % Fe, 0.8-1.3 wt. % Mg, 0.10-0.30 wt. % Mn, 0.8-1.4 wt. % Si, 0.005-0.15 wt. % Ti, 0.01-3 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In another example, the 6xxx aluminum alloys comprise 0.02-0.15 wt. % Cr, 0.4-1.0 wt. % Cu, 0.15-0.25 wt. % Fe, 0.8-1.3 wt. % Mg, 0.10-0.30 wt. % Mn, 0.8-1.4 wt. % Si, 0.005-0.15 wt. % Ti, 0.05-3 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In another example, the 6xxx aluminum alloys comprise 0.02-0.08 wt. % Cr, 0.4-1.0 wt. % Cu, 0.15-0.25 wt. % Fe, 0.8-1.3 wt. % Mg, 0.10-0.30 wt. % Mn, 0.8-1.4 wt. % Si, 0.005-0.15 wt. % Ti, 0.05-3 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In yet another example, the 6xxx aluminum alloys comprise 0.08-0.15 wt. % Cr, 0.4-1.0 wt. % Cu, 0.15-0.25 wt. % Fe, 0.8-1.3 wt. % Mg, 0.10-0.30 wt. % Mn, 0.8-1.4 wt. % Si, 0.005-0.15 wt. % Ti, 0.05-3 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In another example, the 6xxx aluminum alloys comprise 0.02-0.15 wt. % Cr, 0.4-1.0 wt. % Cu, 0.10-0.30 wt. % Fe, 0.8-1.3 wt. % Mg, 0.10-0.30 wt. % Mn, 0.8-1.4 wt. % Si, 0.005-0.15 wt. % Ti, 0.05-2.5 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In yet another example, the 6xxx aluminum alloys comprise 0.02-0.15 wt. % Cr, 0.4-1.0 wt. % Cu, 0.10-0.30 wt. % Fe, 0.8-1.3 wt. % Mg, 0.10-0.30 wt. % Mn, 0.8-1.4 wt. % Si, 0.005-0.15 wt. % Ti, 0.05-2 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In still another example, the 6xxx aluminum alloys comprise 0.02-0.15 wt. % Cr, 0.4-1.0 wt. % Cu, 0.10-0.30 wt. % Fe, 0.8-1.3 wt. % Mg, 0.10-0.30 wt. % Mn, 0.6-1.5 wt. % Si, 0.005-0.15 wt. % Ti, 0.05-1.5 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In another example, the 6xxx aluminum alloys comprise 0.02-0.15 wt. % Cr, 0.4-1.0 wt. % Cu, 0.10-0.30 wt. % Fe, 0.8-1.3 wt. % Mg, 0.10-0.30 wt. % Mn, 0.6-1.5 wt. % Si, 0.005-0.15 wt. % Ti, 0.05-1 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In still another example, the 6xxx aluminum alloys comprise 0.02-0.15 wt. % Cr, 0.4-1.0 wt. % Cu, 0.10-0.30 wt. % Fe, 0.8-1.3 wt. % Mg, 0.10-0.30 wt. % Mn, 0.6-1.5 wt. % Si, 0.005-0.15 wt. % Ti, 0.05-0.5 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In yet another example, the 6xxx aluminum alloys comprise 0.01-0.15 wt. % Cr, 0.1-1.3 wt. % Cu, 0.15-0.30 wt. % Fe, 0.5-1.3 wt. % Mg, 0.05-0.20 wt. % Mn, 0.5-1.3 wt. % Si, up to 0.1 wt. % Ti, up to 4.0 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

In another example, the sum of the wt. % of Fe and Mn in any of the preceding alloys is less than 0.35 wt. %.

In yet another example, the Ti in any of the preceding alloys is present in 0.0-0.10 wt. %, 0.03-0.08 wt. %, 0.03-0.07 wt. %, 0.03-0.06 wt. %, or 0.03-0.05 wt. %.

In another example, the 6xxx aluminum alloys comprise 0.04-0.13 wt. % Cr, 0.4-1.0 wt. % Cu, 0.15-0.25 wt. % Fe, 0.8-1.3 wt. % Mg, 0.15-0.25 wt. % Mn, 0.6-1.5 wt. % Si, 0.005-0.15 wt. % Ti, 0.05-3 wt. % Zn, up to 0.2 wt. % Zr, up to 0.2 wt. % Sc, up to 0.25 wt. % Sn, up to 0.1 wt. % Ni, up to 0.15 wt. % impurities, remainder aluminum.

Chromium

In various examples, the disclosed alloys may comprise Cr in amounts of from up to 0.25 wt. %, 0.02-0.25 wt. %, 0.03-0.24 wt. %, 0.04-0.23 wt. %, 0.05-0.22 wt. %, 0.06-0.21 wt. %, 0.07-0.20 wt. %, 0.02-0.08 wt. %, 0.04-0.07 wt. %, 0.08-0.15 wt. %, 0.09-0.24 wt. %, or 0.1-0.23 wt. %. For example, the alloy can include 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, or 0.25% Cr. All are expressed in wt %.

Copper

In various examples, the disclosed alloys may comprise Cu in amounts of from 0.4-2.0 wt. %, 0.5-1.0 wt. %, 0.6-1.0 wt. %, 0.4-0.9 wt. %, 0.4-0.8 wt. %, 0.4-0.7 wt. %, 0.4-0.6 wt. %, 0.5-0.8 wt. %, or 0.8-1.0 wt. %. For example, the alloy can include 0.4%, 0.45%, 0.5%, 0.55%, 0.6%, 0.65%, 0.7%, 0.75%, 0.8%, 0.85%, 0.9%, 0.95%, 1.0%, 1.05%, 1.10%, 1.15%, 1.20%, 1.25%, 1.30%, 1.35%, 1.4%, 1.45%, 1.50%, 1.55%, 1.60%, 1.65%, 1.70%, 1.75%, 1.80%, 1.85%, 1.90%, 1.95%, or 2.0% Cu. All are expressed in wt. %.

Magnesium

In various examples, the disclosed alloys may comprise Mg in amounts of from 0.5-2.0 wt. %, 0.8-1.5 wt. %, 0.8-1.3 wt. %, 0.8-1.1 wt. %, or 0.8-1.0 wt. %. For example, the alloy can include 0.5%, 0.55%, 0.6%, 0.65%, 0.7%, 0.75%, 0.8%, 0.85%, 0.9%, 0.95%, 1.0%, 1.1%, 1.2%, 1.3%, 1.4%, 1.5%, 1.6%, 1.7%, 1.8%, 1.9%, or 2.0% Mg. All are expressed in wt. %.

Silicon

In various examples, the disclosed alloys may comprise Si in amounts of from 0.5-1.5 wt. %, 0.6-1.3 wt. %, 0.7-1.1 wt. %, 0.8-1.0 wt. %, or 0.9-1.4 wt. %. For example, the alloy can include 0.5%, 0.55%, 0.6%, 0.65%, 0.7%, 0.75%, 0.8%, 0.85%, 0.9%, 0.95%, 1.0%, 1.1%, 1.2%, 1.3%, 1.4%, or 1.5% Si. All are expressed in wt. %.

Manganese

In various examples, the disclosed alloys may comprise Mn in amounts of from 0.005-0.4 wt. %, 0.1-0.25 wt. %, 0.15-0.20 wt. %, or 0.05-0.15 wt. %. For example, the alloy can include 0.005%, 0.01%, 0.015%, 0.02%, 0.025%, 0.03%, 0.035%, 0.04%, 0.045%, 0.05%, 0.055%, 0.06%. 0.065%, 0.07%, 0.075%, 0.08%, 0.085%, 0.09%, 0.095%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, 0.25%, 0.26%, 0.27%, 0.28%, 0.29%, 0.30%, 0.31%, 0.32%, 0.33%, 0.34%, 0.35%, 0.36%, 0.37%, 0.38%, 0.39%, or 0.40% Mn. All are expressed in wt %.

Iron

In various examples, the disclosed alloys may comprise Fe in amounts of from 0.1-0.3 wt. %, 0.1-0.25 wt. %, 0.1-0.20 wt. %, or 0.1-0.15 wt. %. For example, the alloy can include 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, 0.25%, 0.26%, 0.27%, 0.28%, 0.29%, or 0.30% Fe. All are expressed in wt %.

Zinc

In various examples, the disclosed alloys may comprise Zn in amounts of up to 4.0 wt. % Zn, 0.01-0.05 wt. % Zn, 0.1-2.5 wt. % Zn, 0.001-1.5 wt. % Zn, 0.0-1.0 wt. % Zn, 0.01-0.5 wt. % Zn, 0.5-1.0 wt. % Zn, 1.0-1.9 wt. % Zn, 1.5-2.0 wt. % Zn, 2.0-3.0 wt. % Zn, 0.05-0.5 wt. % Zn, 0.05-1.0 wt. % Zn, 0.05-1.5 wt. % Zn, 0.05-2.0 wt. % Zn, 0.05-2.5 wt. % Zn, or 0.05-3 wt. % Zn. For example, the alloy can include 0.0% 0.01%, 0.02%, 0.03%, 0.04%, 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, 0.20%, 0.21%, 0.22%, 0.23%, 0.24%, 0.25%, 0.26%, 0.27%, 0.28%, 0.29%, 0.30%, 0.31%, 0.32%, 0.33%, 0.34%, 0.35%, 0.36%, 0.37%, 0.38%, 0.39%, 0.40%, 0.41%, 0.42%, 0.43%, 0.44%, 0.45%, 0.46%, 0.47%, 0.48%, 0.49%, 0.50%, 0.55%, 0.60%, 0.65%, 0.70%, 0.75%, 0.80%, 0.85%, 0.90%, 0.95%, 1.0%, 1.1%, 1.2%, 1.3%, 1.4%, 1.5%, 1.6%, 1.7%, 1.8%, 1.9%, 2.0%, 2.1%, 2.2%, 2.3%, 2.4%, 2.5%, 2.6%, 2.7%, 2.8%, 2.9%, 3.0%, 3.1%, 3.2%, 3.3%, 3.4%, 3.5%, 3.6%, 3.7%, 3.8%, 3.9%, or 4.0% Zn. In some cases, Zn is not present in the alloy (i.e., 0%). All are expressed in wt. %.

Titanium

In various examples, the disclosed alloys may comprise Ti in amounts of up to 0.15 wt. %, 0.005-0.15 wt. %, 0.005-0.1 wt. %, 0.01-0.15 wt. %, 0.05-0.15 wt. %, or 0.05-0.1 wt. %. For example, the alloy can include 0.001%, 0.002%, 0.003%, 0.004%, 0.005%, 0.006%, 0.007%, 0.008%, 0.009%, 0.010%, 0.011% 0.012%, 0.013%, 0.014%, 0.015%, 0.016%, 0.017%, 0.018%, 0.019%, 0.020%, 0.021% 0.022%, 0.023%, 0.024%, 0.025%, 0.026%, 0.027%, 0.028%, 0.029%,0.03%, 0.031% 0.032%, 0.033%, 0.034%, 0.035%, 0.036%, 0.037%, 0.038%, 0.039%, 0.04%, 0.041% 0.042%, 0.043%, 0.044%, 0.045%, 0.046%, 0.047%, 0.048%, 0.049%, 0.05%, 0.055%, 0.06%, 0.065%, 0.07%, 0.075%, 0.08%, 0.085%, 0.09%, 0.095%, 0.1%, 0.11%, 0.12%, 0.13%, 0.14%, or 0.15% Ti. In some cases, Ti is not present in the alloy (i.e., 0%). All are expressed in wt. %.

Tin

In various examples, the disclosed alloys described in the examples above may further comprise Sn in amounts of up to 0.25 wt. %, 0.05-0.15 wt. %, 0.06-0.15 wt. %, 0.07-0.15 wt. %, 0.08-0.15 wt. %, 0.09-0.15 wt. %, 0.1-0.15 wt. %, 0.05-0.14 wt. %, 0.05-0.13 wt. %, 0.05-0.12 wt. %, or 0.05-0.11 wt. %. For example, the alloy can include 0.001%, 0.002%, 0.003%, 0.004%, 0.005%, 0.006%, 0.007%, 0.008%, 0.009%, 0.010%, 0.011% 0.012%, 0.013%, 0.014%, 0.015%, 0.016%, 0.017%, 0.018%, 0.019%, 0.020%, 0.021% 0.022%, 0.023%, 0.024%, 0.025%, 0.026%, 0.027%, 0.028%, 0.029%,0.03%, 0.031% 0.032%, 0.033%, 0.034%, 0.035%, 0.036%, 0.037%, 0.038%, 0.039%, 0.04%, 0.041% 0.042%, 0.043%, 0.044%, 0.045%, 0.046%, 0.047%, 0.048%, 0.049%, 0.05%, 0.055%, 0.06%, 0.065%, 0.07%, 0.075%, 0.08%, 0.085%, 0.09%, 0.095%, 0.1%, 0.11%, 0.12%, 0.13%, 0.14%, 0.15%, 0.16%, 0.17%, 0.18%, 0.19%, 0.20%, 0.21%, 0.22%, 0.23%, 0.24%, or 0.25% Sn. In some cases, Sn is not present in the alloy (i.e., 0%). All are expressed in wt. %.

Zirconium

In various examples, the alloy includes zirconium (Zr) in an amount up to about 0.2% (e.g., from 0% to 0.2%, from 0.01% to 0.2%, from 0.01% to 0.15%, from 0.01% to 0.1%, or from 0.02% to 0.09%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Zr. In certain aspects, Zr is not present in the alloy (i.e., 0%). All expressed in wt. %.

Scandium

In certain aspects, the alloy includes scandium (Sc) in an amount up to about 0.2% (e.g., from 0% to 0.2%, from 0.01% to 0.2%, from 0.05% to 0.15%, or from 0.05% to 0.2%) based on the total weight of the alloy. For example, the alloy can include 0.001%, 0.002%, 0.003%, 0.004%, 0.005%, 0.006%, 0.007%, 0.008%, 0.009%, 0.01%, 0.02%, 0.03%, 0.04%, 0.05%, 0.06%, 0.07%, 0.08%, 0.09%, 0.1%, 0.11%, 0.12%, 0.13%, 0.14%, 0.15%, 0.16%, 0.17%, 0.18%, 0.19%, or 0.2% Sc. In certain examples, Sc is not present in the alloy (i.e., 0%). All expressed in wt. %.

Nickel

In certain aspects, the alloy includes nickel (Ni) in an amount up to about 0.07% (e.g., from 0% to 0.05%, 0.01% to 0.07%, from 0.03% to 0.034%, from 0.02% to 0.03%, from 0.034 to 0.054%, from 0.03 to 0.06%, or from 0.001% to 0.06%) based on the total weight of the alloy. For example, the alloy can include 0.01%, 0.011%, 0.012%, 0.013%, 0.014%, 0.015%, 0.016%, 0.017%, 0.018%, 0.019%, 0.02%, 0.021%, 0.022%, 0.023%, 0.024%, 0.025%, 0.026%, 0.027%, 0.028%, 0.029%, 0.03%, 0.031%, 0.032%, 0.033%, 0.034%, 0.035%, 0.036%, 0.037%, 0.038%, 0.039%, 0.04%,0.041%, 0.042%, 0.043%, 0.044%, 0.045%, 0.046%, 0.047%, 0.048%, 0.049%, 0.05%, 0.0521%, 0.052%, 0.053%, 0.054%, 0.055%, 0.056%, 0.057%, 0.058%, 0.059%, 0.06%, 0.061%, 0.062%, 0.063%, 0.064%, 0.065%, 0.066%, 0.067%, 0.068%, 0.069%, or 0.07% Ni. In certain aspects, Ni is not present in the alloy (i.e., 0%). All expressed in wt. %.

Others

In addition to the examples above, the disclosed alloy can contain the following: up to 0.5 wt. % Ga (e.g., from 0.01% to 0.40% or from 0.05% to 0.25%), up to 0.5 wt. % Hf (e.g., from 0.01% to 0.40% or from 0.05% to 0.25%), up to 3 wt. % Ag (e.g., from 0.1% to 2.5% or from 0.5% to 2.0%), up to 2 wt. % for at least one of the alloying elements Li, Pb, or Bi (e.g., from 0.1% to 2.0% or from 0.5% to 1.5%), or up to 0.5 wt. % of at least one of the following elements Ni, V, Sc, Mo, Co or other rare earth elements (e.g., from 0.01% to 0.40% or from 0.05% to 0.25%). All percentages expressed in wt. % and based on the total weight of the alloy. For example, the alloy can include 0.05%, 0.06%, 0.07%, 0.08%, 0.09%, 0.10%, 0.11%, 0.12%, 0.13%, 0.14%, 0.15%, 0.16%, 0.17%, 0.18%, 0.19%, or 0.20% of one or more of Mo, Nb, Be, B, Co, Sn, Sr, V, In, Hf, Ag, and Ni. All are expressed in wt. %.

Table 1 presents a reference alloy (AA6061) for comparative purposes and several examples of alloys. All numbers are in (wt. %), remainder aluminum. In the example alloys, each alloy may contain up to about 0.15 wt. % impurities.

TABLE 1

| Alloy | Cr | Cu | Fe | Mg | Mn | Si | Ti | Zn | Sn |
|---|---|---|---|---|---|---|---|---|---|
| AA6061 (reference) | 0.25 | 0.26 | 0.42 | 0.98 | 0.03 | 0.56 | 0.04 | 0.01 | |
| Embodiment 1 | 0.03 | 0.8 | 0.15 | 1.0 | 0.2 | 1.2 | 0.04 | 0.01 | 0 |
| Embodiment 2-1 | 0.03 | 0.4 | 0.15 | 1.3 | 0.2 | 1.3 | 0.04 | 0.01 | 0 |
| Embodiment 2-2 | 0.1 | 0.4 | 0.15 | 1.3 | 0.2 | 1.3 | 0.04 | 0.01 | 0 |
| Embodiment 1 + Sn | 0.03-0.15 | 0.6-1.0 | 0.15-0.25 | 0.8-1.3 | 0.15-0.25 | 1.0-1.4 | 0.005-0.1 | 0.01-0.05 | 0.05-0.15 |
| Embodiment 2 + Sn | 0.03-0.15 | 0.4-0.8 | 0.15-0.25 | 0.8-1.3 | 0.15-0.25 | 1.0-1.4 | 0.005-0.1 | 0.01-0.05 | 0.05-0.15 |
| Embodiment 1 + Zn subrange | 0.03-0.15 | 0.6-1.0 | 0.15-0.25 | 0.8-1.3 | 0.15-0.25 | 1.0-1.4 | 0.005-0.1 | 0.01-0.5 | 0 |
| Embodiment 1 + Zn subrange (2) | 0.03-0.15 | 0.6-1.0 | 0.15-0.25 | 0.8-1.3 | 0.15-0.25 | 1.0-1.4 | 0.005-0.1 | 0.5-1.0 | 0 |
| Embodiment 1 + Zn subrange (3) | 0.03-0.15 | 0.6-1.0 | 0.15-0.25 | 0.8-1.3 | 0.15-0.25 | 1.0-1.4 | 0.005-0.1 | 1.0-1.9 | 0 |
| Embodiment 1 + | 0.03-0.15 | 0.6-1.0 | 0.15-0.25 | 0.8-1.3 | 0.15-0.25 | 1.0-1.4 | 0.005-0.1 | 1.5-2.0 | 0 |

TABLE 1-continued

| Alloy | Cr | Cu | Fe | Mg | Mn | Si | Ti | Zn | Sn |
|---|---|---|---|---|---|---|---|---|---|
| Zn subrange (4) | | | | | | | | | |
| Embodiment 1 + Zn subrange (4) | 0.03-0.15 | 0.6-1.0 | 0.15-0.25 | 0.8-1.3 | 0.15-0.25 | 1.0-1.4 | 0.005-0.1 | 2.0-3.0 | 0 |
| Embodiment 3 | 0.027 | 0.924 | 0.204 | 0.936 | 0.258 | 0.675 | 0.043 | 0.006 | 0 |
| Embodiment 4 | 0.034 | 0.611 | 0.157 | 0.768 | 0.174 | 0.909 | 0.048 | 0.005 | 0 |

In some examples, such as Embodiments 1 and 2, alloys were designed to ensure that the sum of Fe and Mn is kept at or below 0.35% wt. % for improved bendability.

Process

The 6xxx aluminum alloy described herein can be cast into, for example but not limited to, ingots, billets, slabs, plates, shates or sheets, using any suitable casting method known to those of skill in the art. As a few non-limiting examples, the casting process can include a Direct Chill (DC) casting process and a Continuous Casting (CC) process. The CC process may include, but is not limited to, the use of twin belt casters, twin roll casters, or block casters. In addition, the 6xxx aluminum alloys described herein may be formed into extrusions using any suitable method known to those skilled in the art. The DC casting process, the CC process, and the extrusion process can be performed according to standards commonly used in the aluminum industry as known to one of ordinary skill in the art. The alloy, as a cast ingot, billet, slab, plate, shate, sheet, or extrusion, can then be subjected to further processing steps.

Figure 1:
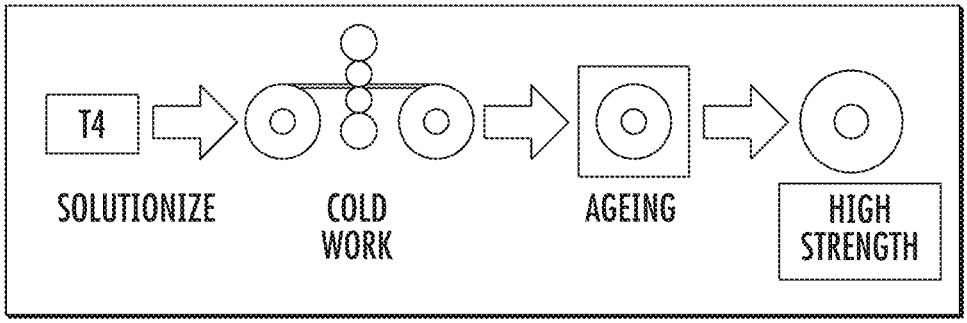
FIG. 1 is a schematic representation of a method of manufacturing high strength 6xxx aluminum alloys according to one example.

FIG. 1 shows a schematic of one exemplary process. In some examples, the 6xxx aluminum alloy is prepared by solutionizing the alloy at a temperature between about 520° C. and about 590° C. The solutionizing was followed by quenching and cold work (CW), and then thermal treatment (artificial aging). The percentage of post solutionizing CW varies from at least 5% to 80% for example, from 10% to 70%, 10% to 45%, 10% to 40%, 10% to 35%, 10% to 30%, 10% to 25%, or 10% to 20%, 20% to 60%, or 20 to 25% CW. By first solutionizing and then cold working followed by artificial aging, improved properties in terms of yield strength and ultimate tensile strength were obtained without sacrificing the total % elongation. The % CW is referred to in this context as the change in thickness due to cold rolling divided by the initial strip thickness prior to cold rolling. In another exemplary process, the 6xxx aluminum alloy is prepared by solutionizing the alloy followed by thermal treatment (artificial aging) without CW. Cold work is also referred to as cold reduction (CR) in this application.

After solution heat treatment followed by quench, a super saturated solid solution is attained. During cold reduction, further dislocations are generated during to the forming operation. While not wanting to be bound by the following statement, it is believed that this results in increased strength and aids elemental diffusion leading to higher density nucleation sites for precipitate formation during subsequent artificial aging. While not wanting to be bound by the following statement, it is believed that this will suppress formation of clusters or Guinier-Preston (GP) zones which may be attributed to annihilation of quench in vacancies by dislocations. During subsequent artificial aging, maximum strength is reached via precipitation of β"/β' needle shape precipitates and Cu containing L phase. It is believed that the cold work results in increased kinetics and in higher paint bake strength and accelerated artificial aging response. While not wanting to be bound by the following statement, it is believed that cold rolling after solution heat treatment results in stabilization of the β"/β' needle shape precipitates and suppression of β phase. The final strength of the material is attributed to precipitation strengthening and strain hardening due to the increased dislocation density generated during cold work.

In some examples, the following processing conditions were applied. The samples were homogenized at 510-590° C. for 0.5-4 hours followed by hot rolling. For example, the homogenization temperature can be 515° C., 520° C., 525° C., 530° C., 535° C., 540° C., 545° C., 550° C., 555° C., 560° C., 565° C., 570° C., 575° C., 580° C., or 585° C. The homogenization time can be 1 hour, 1.5 hours, 2 hours, 2.5 hours, 3 hours, or 3.5 hours. The target laydown temperature was 420-480° C. For example, the laydown temperature can be 425° C., 430° C., 435° C., 440° C., 445° C., 450° C., 455° C., 460° C., 465° C., 470° C., or 475° C. The target laydown temperature indicates the temperature of the ingot, slab, billet, plate, shate, or sheet before hot rolling. The samples were hot rolled to 5 mm-18 mm. For example, the gauge can be 6 mm, 7 mm, 8 mm, 9 mm, 10 mm, 11 mm, 12 mm, 13 mm, 14 mm, 15 mm, 16 mm, or 17 mm. Preferably, the gauges are about 11.7 mm and 9.4 mm.

The target exit hot roll temperature may be 300-400° C. The exit hot roll temperature can be 300° C., 305° C., 310° C., 315° C., 320° C., 325° C., 330° C., 335° C., 340° C., 345° C., 350° C., 355° C., 360° C., 365° C., 370° C., 375° C., 380° C., 385° C., 390° C., 395° C., or 400° C. The samples were subsequently solution heat treated at 510-540° C. for 0.5 to 1 hour followed by immediate ice water quench to ambient temperature to ensure maximum saturation. The solution heat treatment temperature can be 515° C., 520° C., 525° C., 530° C., or 535° C. It is estimated that the duration to reach ambient temperature will vary based on the material thickness and is estimated to be between 1.5-5 seconds on average. Preferably, the amount of time to reach ambient temperature can be 2 seconds, 2.5 seconds, 3 seconds, 3.5 seconds, 4 seconds, or 4.5 seconds. Ambient temperature may be about −10° C. to about 60° C. Ambient temperature may also be 0° C., 10° C., 20° C., 30° C., 40° C., or 50° C.

In some examples, a method of making an aluminum alloy sheet can include the following steps: casting an 6xxx aluminum alloy; rapidly heating the cast 6xxx aluminum alloy to a temperature of 510° C. to 590° C.; maintaining the cast 6xxx aluminum alloy at the temperature of 510° C. to 590° C. for 0.5 to 4 hours; decreasing the temperature to 420° C. to 480° C.; hot rolling the cast 6xxx aluminum alloy into the aluminum alloy sheet, the rolled aluminum alloy sheet having a thickness up to 18 mm at a hot roll exit temperature of 330° C. to 390° C.; heat treating the aluminum alloy sheet at a temperature of 510° C. to 540° C. for 0.5 to 1 hour; and quenching the aluminum alloy sheet to ambient temperature.

In some examples, a method of making an aluminum alloy sheet can include the following steps: continuously casting an 6xxx aluminum alloy; rapidly heating the continuously cast 6xxx aluminum alloy to a temperature of 510°

C. to 590° C.; maintaining the temperature of 510° C. to 590° C. for 0.5 to 4 hours; decreasing the temperature to 420° C. to 480° C.; hot rolling the continuously cast 6xxx aluminum alloy to create the aluminum alloy sheet, the aluminum alloy sheet having a thickness below 1 mm at a hot roll exit temperature of 330° C. to 390° C.; heat treating the aluminum alloy sheet at a temperature of 510° C. to 540° C. for 0.5 to 1 hour; and, quenching the aluminum alloy sheet to ambient temperature.

Subsequently, two additional processing methods were examined.

Method 1

Following the quench after solution heat treatment, samples were artificially aged at 200° C. for 0.5 to 6 hours as soon as possible but always within 24 hours. The time interval between completion of solution heat treatment and quench, and initiation of artificial aging (thermal treatment) was below 24 hours, to avoid effects of natural aging. Artificial aging can occur at temperatures ranging from about 160° C. to about 240° C., from about 170° C. to about 210° C. or about 180° C. to about 200° C.

Method 2

Following the quench after solution heat treatment, samples were cold rolled, prior to artificial aging (thermal treatment), from an initial gauge of ~11 mm and ~9 mm to ~7 mm and ~3 mm, respectively. This can be defined as ~20% and 40%-45% CW. The time interval between completion of solution heat treatment and quench and initiation of artificial aging was below 24 hours, to avoid effects of natural aging. The % CW applied for trial purposes was 40% resulting in a final gauge of 7 mm (rolled from an initial thickness of 11.7 mm) and 3 mm (rolled from an initial thickness of 5 mm). This was followed by subsequent aging at 200° C. for 1 to 6 hours. In some cases, the subsequent aging can occur at 200° C. for 0.5 to 6 hours.

In summary, the initial steps of the process comprise sequentially: casting; homogenizing; hot rolling; solution heat treatment; and quench. Next, either or both Method 1 or Method 2 are followed. Method 1 comprises the step of aging. Method 2 comprises cold rolling and subsequent aging.

Gauges of aluminum sheet produced with the described methods can be up to 15 mm in thickness. For example, the gauges of aluminum sheet produced with the disclosed methods can be 15 mm, 14 mm, 13 mm, 12 mm, 11 mm, 10 mm, 9 mm, 8 mm, 7 mm, 6 mm, 5 mm, 4 mm, 3.5 mm, 3 mm, 2 mm, 1 mm, or any gauge less than 1 mm in thickness for example, 0.9 mm, 0.8 mm, 0.7 mm, 0.6 mm, 0.5 mm, 0.4 mm, 0.3 mm, 0.2 mm, or 0.1 mm. Starting thicknesses can be up to 20 mm. In some examples, the aluminum alloy sheets produced with the described methods can have a final gauge between about 2 mm to about 14 mm.

Mechanical Properties of the Alloys

In comparison to lab cast AA6061, which mimics the industrial composition, based on analysis of commercially produced material, the new examples showed significant improvement in strength (both in the T6 condition due to composition change) and in the T8x condition (due to a combination of method of manufacture (cold working) and composition changes). Additionally, the disclosed alloys may be produced in, but not limited to, the T4 and F tempers.

This new method of manufacture and composition change is an improvement over current alloys such as AA6061. The new aspects, as illustrated in the previous section, are related to a combination of (i) method of manufacture (via cold rolling after solution heat treatment and quenching) and (ii) composition modification at various Cu, Si, Mg and Cr wt. %.

Figure 2:
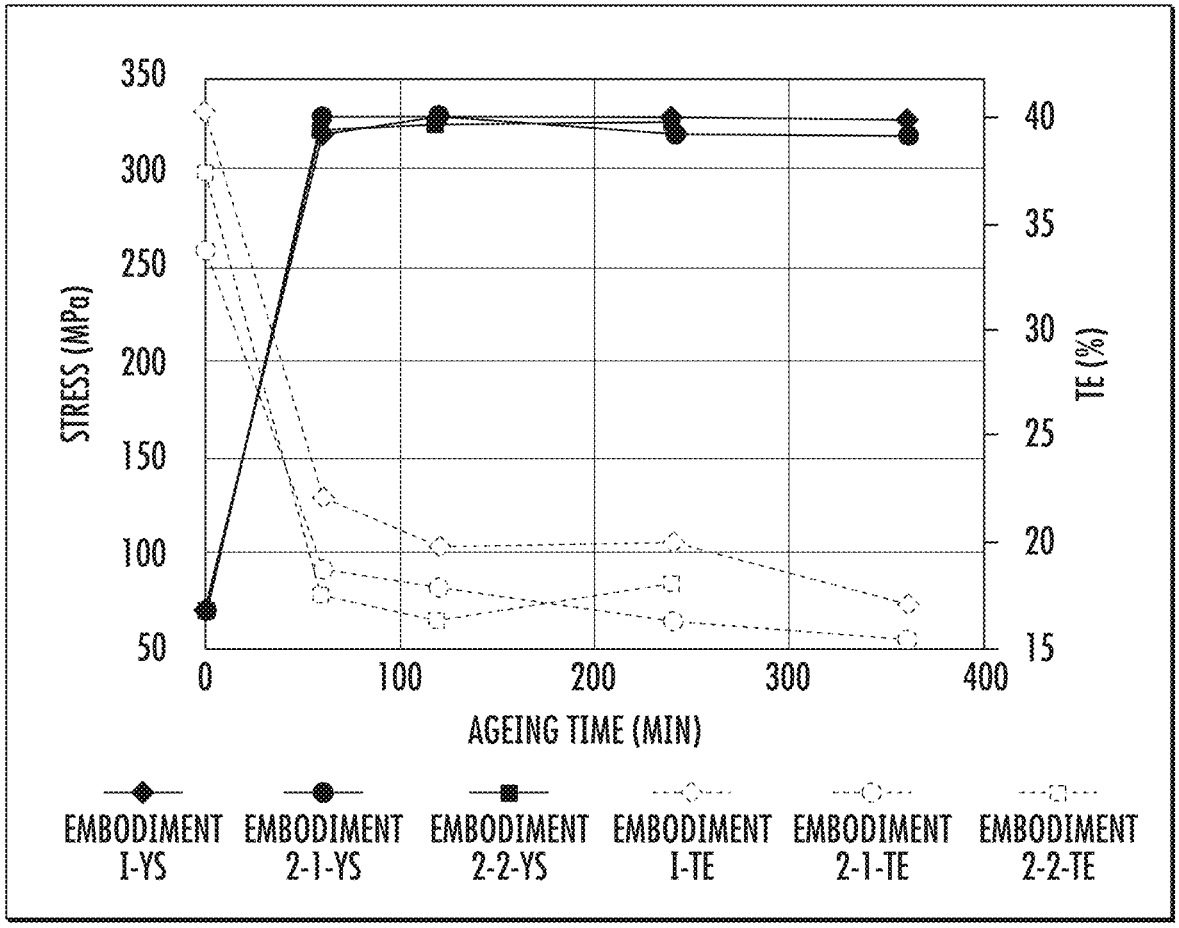
FIG. 2 presents a summary of yield strength ("YS") in MPa on the left y-axis and total percent elongation (TE %) on the right y-axis for selected examples aged for various periods of time (x-axis, minutes) at 200° C. after 40% cold work (CW). Embodiment 1, Embodiments 2-1 and 2-2 are examples shown in Table 1.
Figure 3:
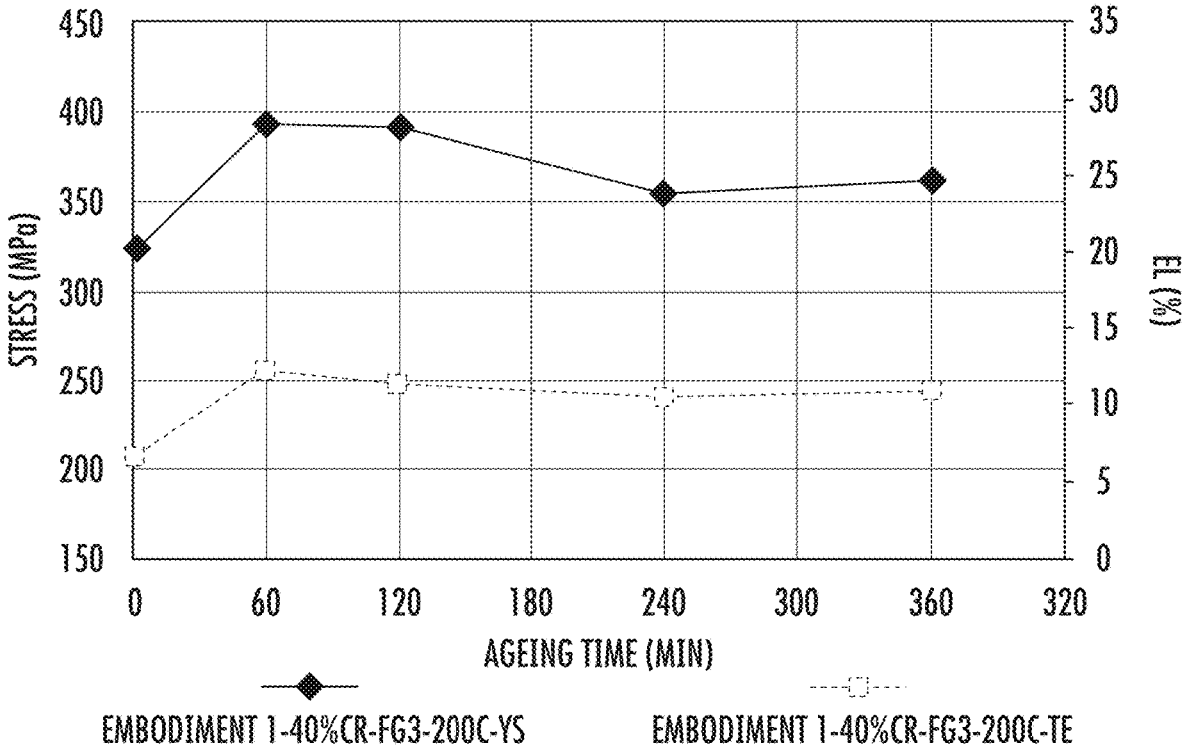
FIG. 3 is a schematic representation of the yield strength on the left y-axis in MPa of Embodiment 1 with 40% CW (diamonds) and a function of various aging times in minutes at 200° C. Final gauge of the sheet is 3 mm. The right y-axis shows percent elongation of Embodiment 1 as a function of various aging times in minutes with 40% CW shown in squares.

Table 2 summarizes the improved mechanical properties of two exemplary alloys in comparison to AA6061. FIGS. 2 and 3 show additional data related to the properties of the exemplary alloys. Yield strength (YS) in MPa and percent elongation (EL %) are shown.

TABLE 2

| Condition | Initial thickness (mm) | YS (MPa) | EL (%) | Remark |
|---|---|---|---|---|
| AA6061 (industrial production) | 3-6 | 250-260 | 14-18 | Baseline industrial cast |
| AA6061 (Lab cast) | 5 | 291 | 20 | Baseline lab cast |
| Embodiment 1 (T6 condition) aged at 200° C. for 1 hour | 5 | 324 | 19 | Effect of composition |
| Embodiment 1 (T8x condition) 40% CW and aged at 200° C. for 1 hour | 5 | 393 | 12 | Effect of method of manufacture and composition |

Figure 4A:
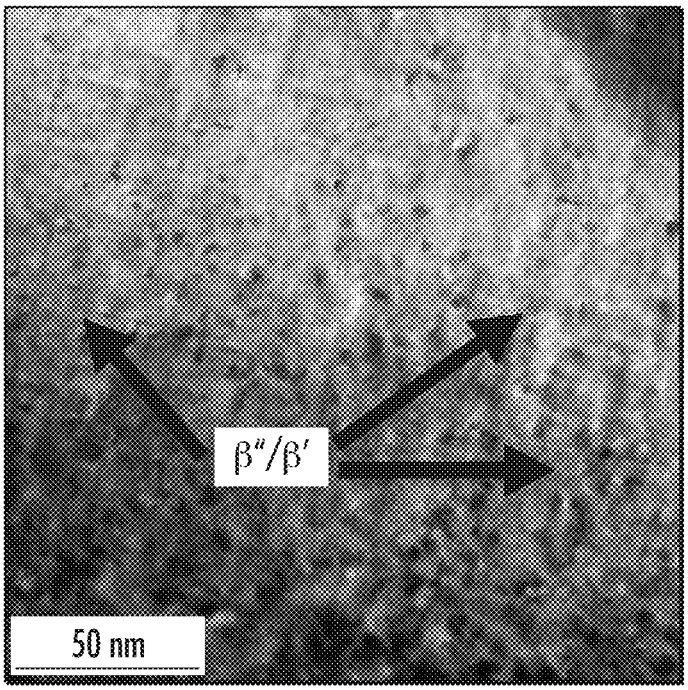
FIG. 4A is a transmission electron microscopy (TEM) micrograph of Embodiment 1 in a T6 artificially aged condition showing β"/β' precipitates (25-100 nm) (length bar=50 nm) examined along the <001>zone axis.
Figure 4B:
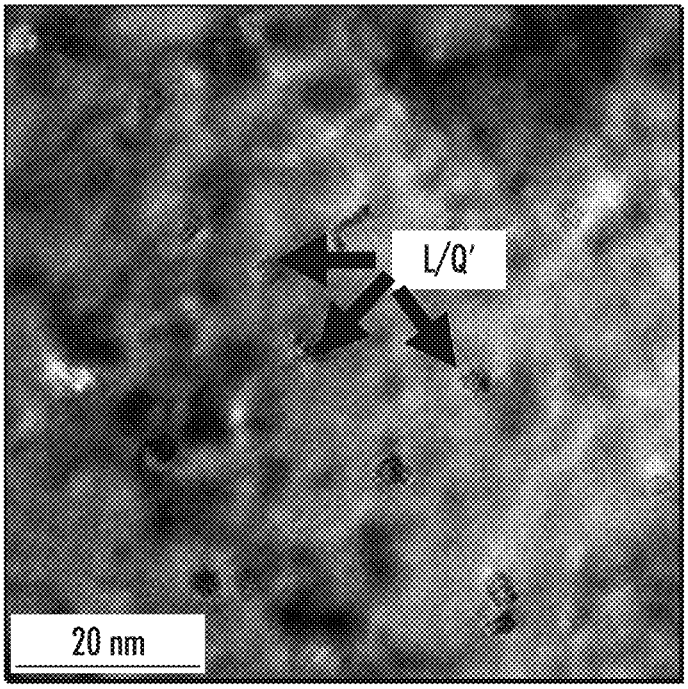
FIG. 4B is a transmission electron microscopy (TEM) micrograph of Embodiment 1 in a T6 artificially aged condition showing Cu containing L/Q' phase precipitates (2-5 nm) (length bar=20 nm) examined along the <001> zone axis.
Figure 5A:
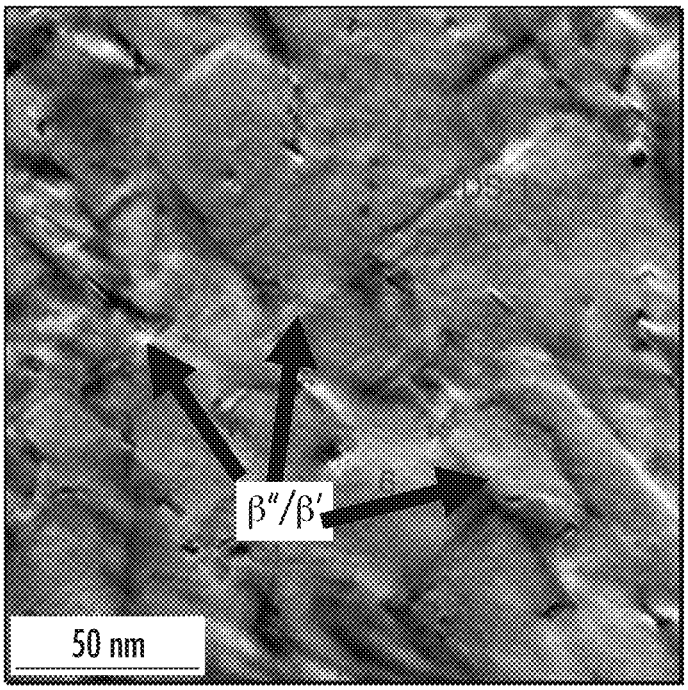
FIG. 5A is a TEM micrograph of Embodiment 1 in a T8x condition (40% CW after solution heat treatment followed by artificial aging at 200° C. for 1 hour) showing β"/β' precipitates along dislocations generated during cold rolling.
Figure 5B:
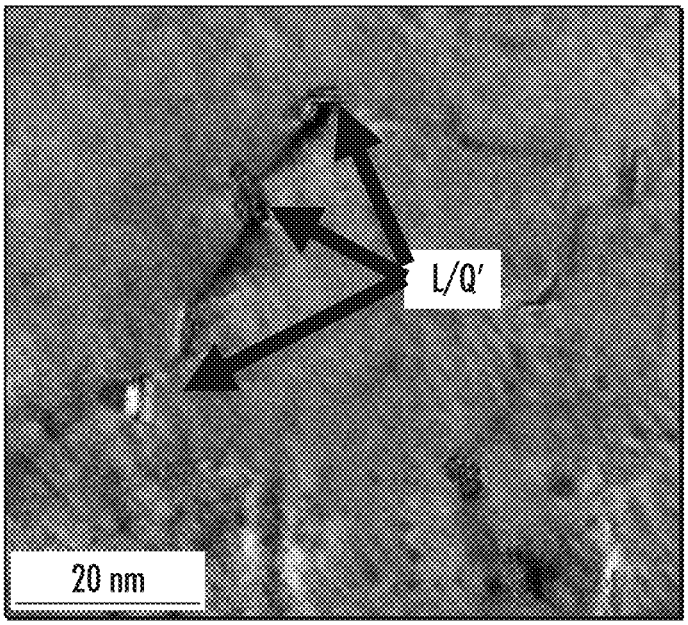
FIG. 5B is a TEM micrograph of Embodiment 1 in a T8x condition (40% CW after solution heat treatment followed by artificial aging at 200° C. for 1 hour) showing L/Q' phase precipitates along dislocations generated during cold rolling. Precipitates appear to be slightly coarser compared to T6 temper. Further strain hardening due to cold work is observed leading to a combination of precipitation and dislocation strengthening.

These alloys have been tested for strength values and % elongation in T6 and T8x conditions. Transmission electron microscopy (TEM) examination was performed to confirm the precipitation types and strengthening mechanism (See FIGS. 4 and 5). In some examples, a 6xxx aluminum alloy sheet made according to a method described herein can have a yield strength of at least 300 MPa, for example between about 300 MPa to 450 MPa. In some examples, a 6xxx aluminum alloy sheet made according to the a method described herein can have an elongation of at least 10%.

In some examples, a 6xxx aluminum alloy sheet made according to a method described herein can have a minimum r/t ratio of the aluminum alloy sheet of about 1.2 without cracking. The r/t ratio can provide an assessment of the bendability of a material. As described below, the bendability was assessed based on the r/t ratio, where r is the radius of the tool (die) used and t is the thickness of the material. A lower r/t ratio indicates better bendability of the material.

Figure 6:
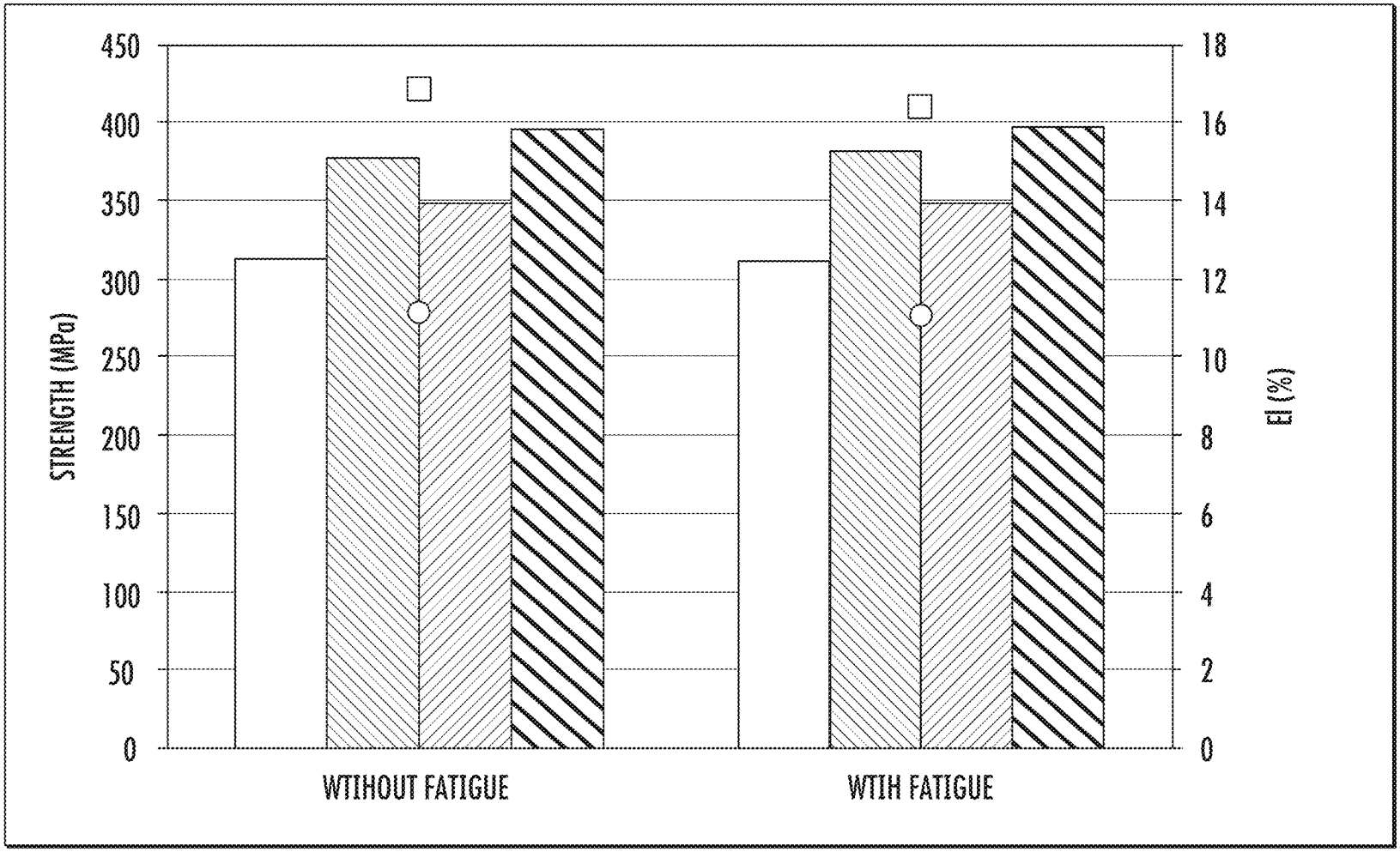
FIG. 6 is a bar chart showing the effect of no fatigue (left four histogram bars) or fatigue (right four histogram bars) on in-service tensile strength (yield strength in MPa on the left y-axis), and percent elongation on the right y-axis (El %) for an AA6061 baseline alloy and Embodiment 1, each with 40% CW. Initial results show that the in-service strength conditions are maintained. The circular symbol represents total elongation of Embodiment 1 after 40% CW. The square symbol indicates the total elongation of the reference material AA6061 with 40% CW. The left two histogram bars in each group of four histogram bars represent yield strength of AA6061 (left bar) and Embodiment 1 (right bar). The right two histogram bars in each group of four histogram bars represent ultimate tensile strength of AA6061 (left bar) and Embodiment 1 (right bar). The data show no significant effect on strength or percent elongation whether subjected to fatigue or no fatigue.

In addition, the alloys have been tested to assess in-service load properties. Specifically, variants were tested where a fatigue load of 70 MPa was applied at an R value of −1, which is considered a severe condition from an application standpoint, at a temperature of 60° C. After 100,000 cycles, the samples were subsequently tested to determine tensile strength values. Initial data suggest that the strength is maintained after fatigue loading in comparison to baseline metal not subjected to fatigue conditions (See FIG. 6).

Figure 7A:
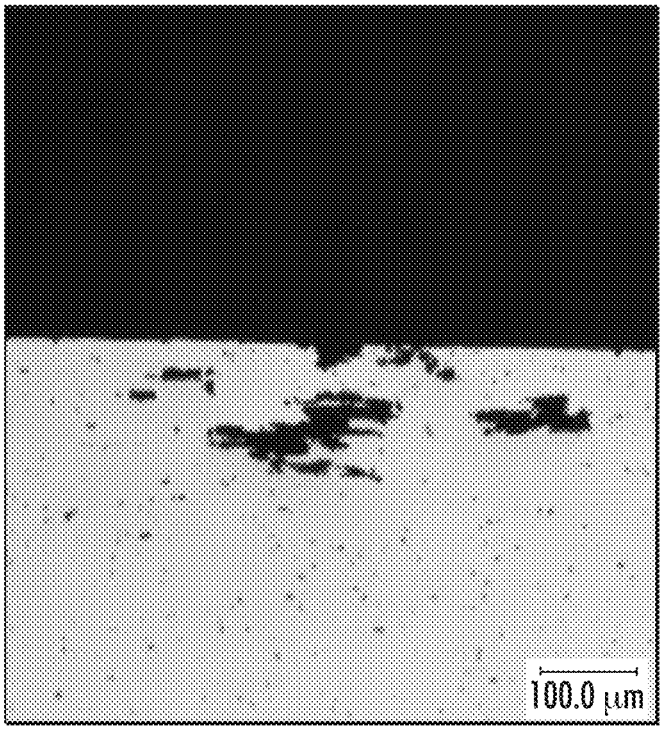
FIGS. 7A and 7B are images of the cross section of samples after ASTM G110 corrosion tests displaying the corrosion behavior of AA6061 T8x (FIG. 7A) and Embodiment 1 T8x (FIG. 7B). Comparable corrosion behavior was observed between both samples. The scale bars for FIGS. 7A and 7B are 100 microns.
Figure 7B:
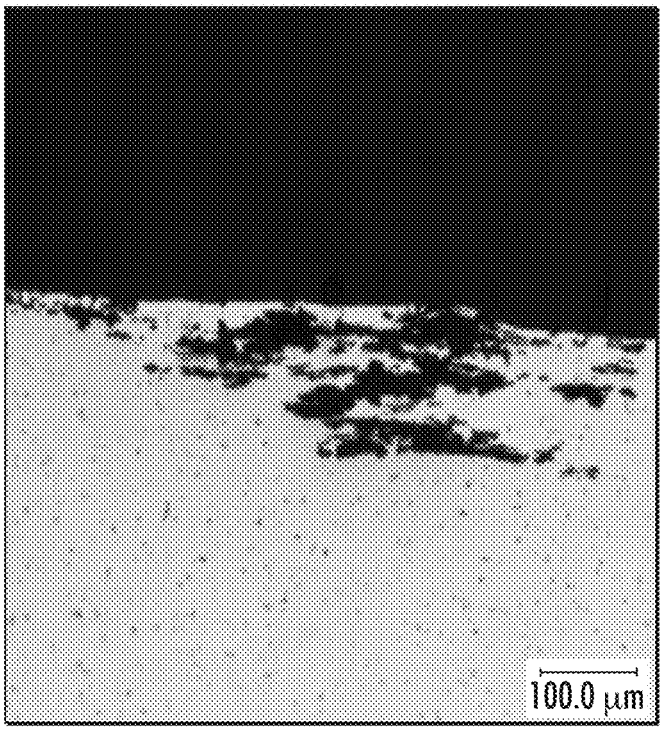

Finally, the disclosed alloys were tested in corrosive conditions based on ASTM G110. It was observed that the corrosion behavior of Embodiment 1 is comparable to the AA6061 current baseline which is considered to be of an excellent corrosion resistance based on the initial findings (See FIG. 7).

A summary of the findings presented in FIGS. 2-6 is summarized below, showing strength values during artificial aging at 200° C., TEM images summarizing the strengthening mechanisms and confirming that the strength values are being maintained after a fatigue loading is applied and tested for 100,000 cycles.

The following examples will serve to further illustrate the invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

EXAMPLE 1

Exemplary alloys having the compositions listed in Table 1 were produced according to the following exemplary methods: the as-cast aluminum alloy ingots were homogenized at a temperature between about 520° C. and about 580° C. for at least 12 hours; the homogenized ingots were then hot rolled to an intermediate gauge comprising 16 passes through a hot roll mill, wherein the ingots entered the hot roll mill at a temperature between about 500° C. and about 540° C. and exited the hot roll mill at a temperature between about 300° C. and 400° C.; the intermediate gauge aluminum alloys were then optionally cold rolled to aluminum alloy sheets having a first gauge between about 2 mm and about 4 mm; the aluminum alloy sheets were solutionized at a temperature between about 520° C. and 590° C.; the sheets were quenched, either with water and/or air; the sheets were optionally cold rolled to a final gauge between about 1 mm and about 3 mm (i.e., the sheets were subjected to a cold reduction of about 20% to about 70% (e.g., 25%, or 50%)); the sheets were heat treated at a temperature between about 120° C. and about 180° C. for a time period of about 30 minutes to about 48 hours (e.g., 140° C. to 160° C. for 5 hours to 15 hours).

Figure 8:
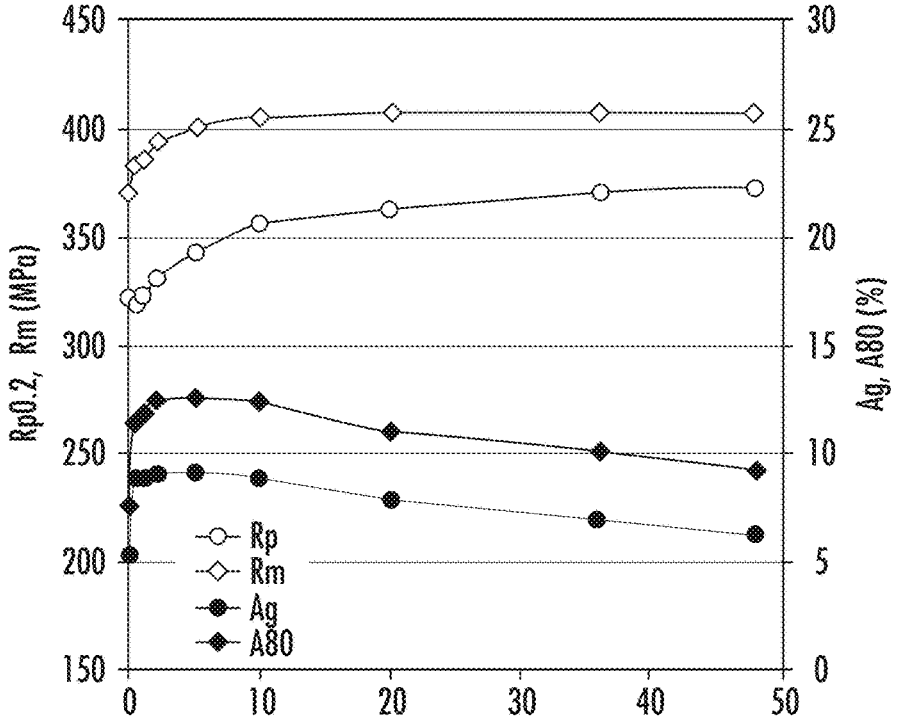
FIG. 8 is chart showing an aging curve following 30% CW. The left y-axis indicates strength in MPa, time (in hours) at 140° C. is indicated on the x-axis and elongation percent (A80) is shown on the right y-axis. These data were obtained using AA6451 with 30% cold work (CW). Rp0.2=yield strength, Rm=tensile strength, Ag=uniform elongation (elongation at highest Rm), and A80=overall elongation. This graph shows that after 10 hours, the strength increases or stays constant and the elongation decreases.

Exemplary alloys were further subjected to artificial aging to assess the effect on tensile strength and elongation. FIG. 8 is a schematic representation of an aging curve following 30% CW. The left vertical axis indicates strength in MPa, time at 140° C. in hours is indicated on the horizontal axis and elongation percent (A80) is shown on the right vertical axis. These data were obtained using AA6451 with 30% CW. Rp0.2 refers to yield strength, Rm refers to tensile strength, Ag refers to uniform elongation (elongation at highest Rm), and A80 refers to overall elongation. This table shows that after 10 hours, the strength increases or stays constant and the elongation decreases. In FIG. 8 and in FIG. 9, the samples were run at a 2 mm gauge.

Figure 9:
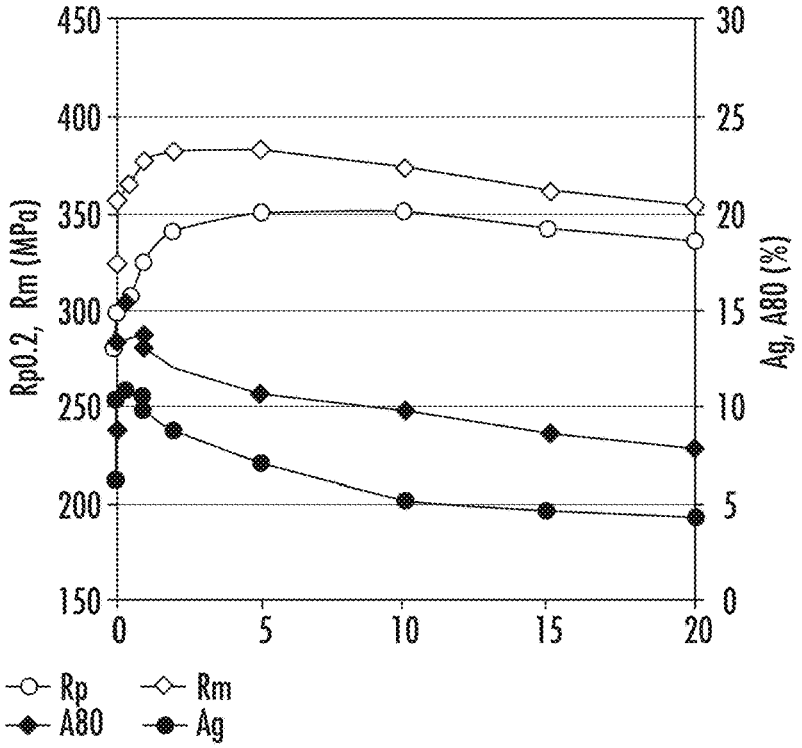
FIG. 9 is a chart showing an aging curve following 23% CW. The left y-axis indicates strength in MPa, time at 170° C. in hours is indicated on the x-axis and elongation percent (A80) is shown on the right y-axis. These data were obtained using AA 6451 with 23% cold work. Yield strength (Rp) peaks at 5-10 hours. Tensile strength (Rm) declines after 2.5 hours. Elongation declines after aging. Symbols Rp, Rm, A80 and Ag are used as in FIG. 8.

FIG. 9 is a schematic representation of an aging curve following 23% CW. The left y-axis indicates strength in MPa, time at 170° C. in hours is indicated on the x-axis and elongation percent (A80) is shown on the right y-axis. These data were obtained using AA6451 with 23% cold work. Yield strength (Rp) peaks at 5-10 hours. Tensile strength (Rm) declines after 2.5 hours. Elongation declines after aging. Rp0.2 refers to yield strength, Rm refers to tensile strength, Ag refers to uniform elongation (elongation at highest Rm), and A80 refers to overall elongation.

Figure 10:
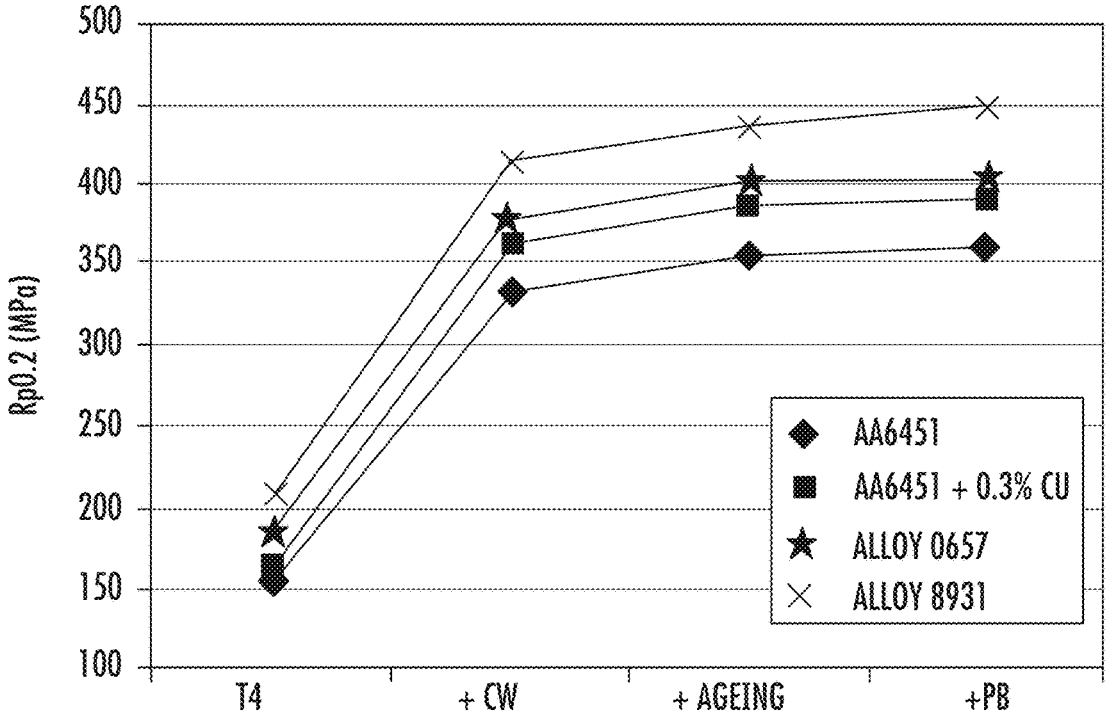
FIG. 10 is a chart showing strength stability in MPa during paint bake at 180° C. for 30 minutes. 50% cold work was applied. Aging occurred at 140° C. for 10 hours except for the X symbol which was 140° C. for 5 hours. This graph shows that the strength of the High strength 6xxx clad/core alloy composition is essentially stable with a paint bake. In fact, the strength slightly increases. X=Alloy 8931 high strength 6xxx clad/core alloy composition (Core: Si-1.25%; Fe-0.2%; Cu-1.25%; Mn-0.25%; Mg-1.25%; Cr-0.04%; Zn-0.02%; and Ti-0.03%; Clad: Si-0.9%; Fe-0.16%; Cu-0.05%; Mn-0.06%; Mg-0.75%; Cr-0.01%; and Zn-0.01%); Diamond=AA6451; Square=AA6451+0.3% Cu, Star=Alloy 0657.

Exemplary alloys were subjected to a simulated paint bake process to assess the effect on tensile strength. FIG. 10 is a schematic representation of strength stability in MPa during paint bake at 180° C. for 3 minutes. 50% cold work was applied. Aging occurred at 140° C. for 10 hours except for the X symbol which was 140° C. for 5 hours. This graph shows that the strength of the High strength 6xxx clad/core alloy composition is essentially stable with a paint bake. In fact, the strength slightly increases. The legend is shown in FIG. 10 showing that the "X" markers represents Alloy 8931. Alloy 8931 is an exemplary alloy described herein and is a high strength 6xxx clad/core alloy composition (Core: Si-1.25%; Fe-0.2%; Cu-1.25%; Mn-0.25%; Mg-1.25%; Cr-0.04%; Zn-0.02%; and Ti-0.03%; Clad: Si-0.9%; Fe-0.16%; Cu-0.05%; Mn-0.06%; Mg-0.75%; Cr-0.01%; and Zn-0.01%); the "diamond" markers represent AA6451 alloy; the "square" markers represent AA6451+0.3% Cu; and the "star" markers represent Alloy 0657 (an alloy having a composition (Si-1.1%; Fe-0.24%; Cu-0.3%; Mn-0.2%; Mg-0.7%; Cr-0.01%; Zn-0.02%; and Ti-0.02%, remainder Al).

Figure 11:
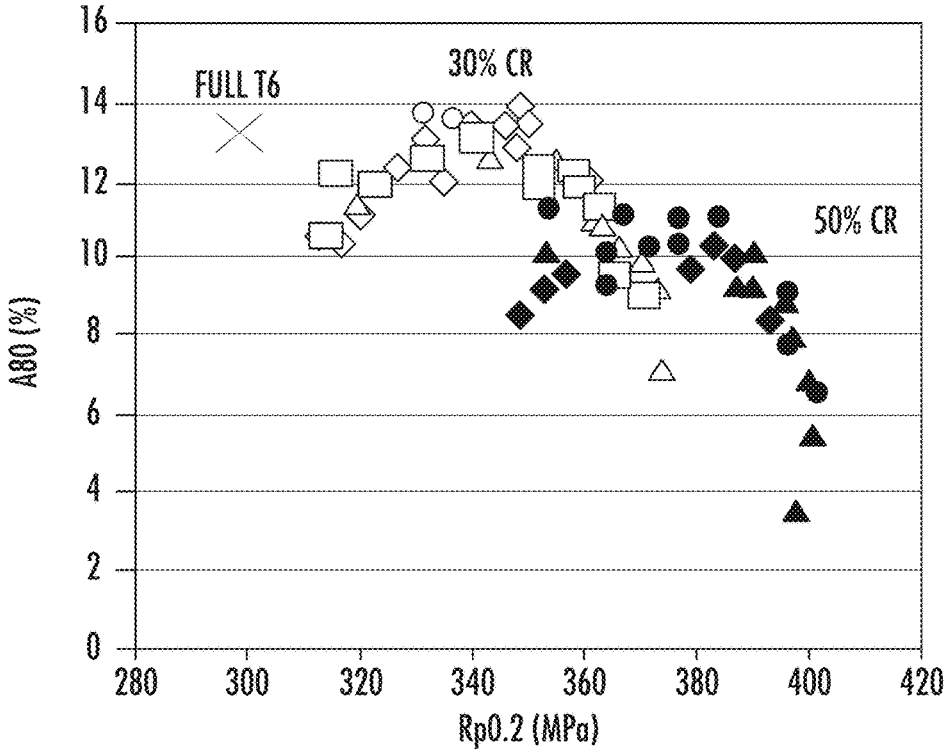
FIG. 11 is a chart showing the effects of 30% or 50% cold reduction (CR) and aging at various temperatures on elongation (y-axis A80) and strength in MPa on the x-axis (Rp0.2). Temperatures for the aging are represented in the figure by symbols as follows: circles=100° C., diamonds=120° C., squares=130° C., and triangles=140° C. The alloy tested was AA6451 plus 0.3% Cu. X represents Alloy AA6451 in the full T6 condition. The figure shows that increasing CR increased strength and decreased elongation. The data demonstrate that a change in cold work can be used to obtain a compromise between strength and elongation. The range of elongation values for 30% CW was from about 7% to about 14% while the corresponding strength levels ranged from about 310 MPa to about 375 MPa. The range of elongation values for 50% CR was from about 3.5% to about 12% while the corresponding strength levels ranged from about 345 MPa to about 400 MPa. 50% CR resulted in higher strength but lower elongation than 30% CR.

FIG. 11 is a chart showing the effects of 30% or 50% cold reduction (CR) and aging at various temperatures on elongation (y-axis A80) and strength in MPa on the x-axis (Rp0.2). Temperatures for the aging are represented in the figure by symbols as follows: circles=100° C., diamonds=120° C., squares=130° C., and triangles=140° C. The alloy tested was AA6451 plus 0.3% Cu in the full T6 condition. The figure shows that increasing CR increased strength and decreased elongation. The data demonstrate that a change in cold work can be used to obtain a compromise between strength and elongation. The range of elongation values for 30% CW was from about 7% to about 14% while the corresponding strength levels ranged from about 310 MPa to about 375 MPa. The range of elongation values for 50% CR was from about 3.5% to about 12% while the corresponding strength levels ranged from about 345 MPa to about 400 MPa. 50% CR resulted in higher strength but lower elongation than 30% CR. Varying the time and temperature during the aging process had a little effect on elongation and strength when compared to the effect of the change in CR.

Figure 12:
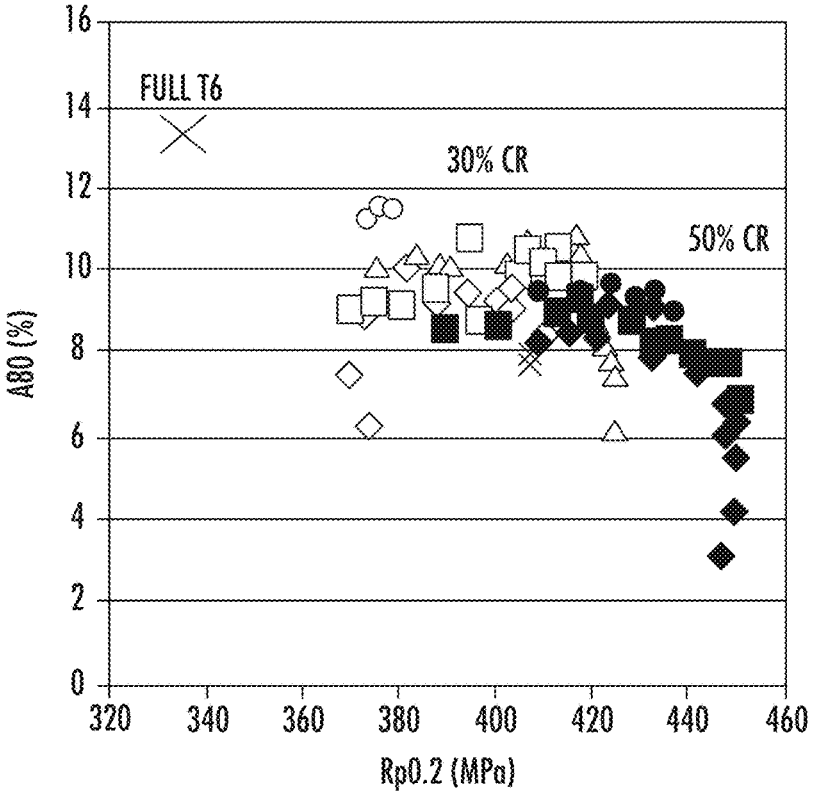
FIG. 12 is a chart showing the effects of 30% or 50% CR and aging at various temperatures on elongation (y-axis A80) and strength in MPa on the x-axis (Rp0.2). Temperatures for the aging are represented in the figure by symbols as follows: circles=100° C., diamonds=120° C., squares=130° C., triangles=140° C., X=160° C., and stars=180° C. The alloy tested, Alloy 8931, was a high strength 6xxx. X represents Alloy 8931 in the full T6 condition (High strength 6xxx clad/core alloy composition (Core: Si-1.25%; Fe-0.2%; Cu-1.25%; Mn-0.25%; Mg-1.25%; Cr-0.04%; Zn-0.02%; and Ti-0.03%; Clad: Si-0.9%; Fe-0.16%; Cu-0.05%; Mn-0.06%; Mg-0.75%.

FIG. 12 is a chart showing the effects of 30% or 50% CR and aging at various temperatures on elongation (y-axis A80) and strength in MPa on the x-axis (Rp0.2). Temperatures for the aging are represented in the figure by symbols as follows: circles=100° C., diamonds=120° C., squares=130° C., triangles=140° C., X=160° C., and stars=180° C. The alloy tested, Alloy 8931, was a high strength 6xxx alloy. X represents Alloy 8931 in the full T6 condition (High strength 6xxx clad/core alloy composition (Core: Si-1.25%; Fe-0.2%; Cu-1.25%; Mn-0.25%; Mg-1.25%; Cr-0.04%; Zn-0.02%; and Ti-0.03%; Clad: Si-0.9%; Fe-0.16%; Cu-0.05%; Mn-0.06%; Mg-0.75%; Cr-0.01%; and Zn-0.01%)). The figure shows that increasing cold work increased strength and decreased elongation. The range of elongation values for 30% CR was from about 6% to about 12% while the corresponding strength levels ranged from about 370 MPa to about 425 MPa. The range of elongation values for 50% CR was from about 3% to about 10% while the corresponding strength levels ranged from about 390 MPa to about 450 MPa. 50% CR resulted in higher strength but lower elongation than 30% CR. The data demonstrate that a change in CR can be used to obtain a compromise between strength and elongation. Varying the time and temperature during the aging process had a little effect on elongation and strength when compared to the effect of the change in CR.

FIG. 13 is a chart showing the effects of CR on change in surface texture of exemplary alloys (r-value) at 90° relative to the rolling direction. The alloy tested was AA6451 plus 0.3% Cu in the T4 condition. Triangles represent the T4 condition plus 50% CR, squares represent T4 condition plus 23% CR, diamonds indicate the T4 condition at 140° C. for 2, 10 or 36 hours of artificial aging. The data demonstrate that increasing cold work increases the r-value 90° to the rolling direction. The data also demonstrate that aging after cold reduction does not significantly change the r-value.

FIG. 14 is a chart showing the effects of CR on change in surface texture (r-value) of exemplary alloys. The alloy tested was AA6451 plus 0.3% Cu in the T4 condition. X indicates the T4 condition, triangles represent the T4 condition plus 23% CR plus 170° C. for 10 hours of artificial aging, squares represent the T4 condition plus 50% CR plus 140° C. for 10 hours of artificial aging, diamonds indicate the T4 condition plus 50% CR. The data demonstrate that increasing cold work increases the r-value 90° to the rolling direction. The data also demonstrate that aging after cold reduction does not significantly change the r-value.

FIG. 15 is a table showing the strengths and elongations of various alloys following 20% to 50% CR and aging at 120° C. to 180° C. Strength measurements were obtained 90° to the rolling direction. Alloys tested were AA6014, AA6451, AA6451 plus 0.3% Cu, Alloy 0657 (having a composition of Si-1.1%; Fe-0.24%; Cu-0.3%; Mn-0.2%; Mg-0.7%; Cr-0.01%; Zn-0.02%; and Ti-0.02%), AA6111, Alloy 8931 (a high strength 6xxx clad/core alloy composition (Core: Si-1.25%; Fe-0.2%; Cu-1.25%; Mn-0.25%; Mg-1.25%; Cr-0.04%; Zn-0.02%; and Ti-0.03%; Clad: Si-0.9%; Fe-0.16%; Cu-0.05%; Mn-0.06%; Mg-0.75%; Cr-0.01%; and Zn-0.01%)).

FIG. 16 is a table showing the effect of 30% CR followed by aging at 140° C. for 10 hours on yield strength (Rp0.2 (MPa)) of AA6451 alloy with 0.3% Cu and AA6451 alloy with 0.1% Cu. The results demonstrate that yield strength increases with 30% CR and aging at 140° C. for 10 hours for the alloy containing 0.3% Cu. There is also increase for the alloy containing 0.1% Cu, but it is not as profound as the alloy with 0.3% Cu.

FIG. 17 is a table showing the effect of 30% CR followed by aging at 140° C. for 10 hours on elongation (A80(%)) of AA6451 alloy with 0.3% Cu and AA6451 alloy with 0.1% Cu The results demonstrate that CR and aging have similar effects on elongation of alloys containing 0.3% Cu and 0.1% Cu.

Samples of Embodiments 1, 2-1, and 2-2 were subject to a 90° bending tests to assess their formability. Dies with progressively lower radius were used to carry out the bending tests. The bendability was assessed based on (r/t ratio), where r is the radius of the tool (die) used and t is the thickness of the material. A lower r/t ratio indicates better bendability of the material. Samples from Embodiments 1, 2-1 and 2-2 were tested in T8x, also known as the high strength condition. The results are summarized in FIG. 18.

It can be seen that comparable bendability (r/t) ratios were observed between Embodiments 1 and 2-2, where failure occurred between an r/t of 1.5 and 2.5. This may be attributed to the fact that the deleterious effect of Cr was compensated for by lowering the magnesium content leading to reduced β"/β' precipitates. In various cases, the disclosed alloys will have a bendability that is lower than an r/t ratio of from about 1.6 to less than 2.5 (where an enhanced bendability is represented by a lower r/t ratio).

EXAMPLE 2

Embodiments 1, 2-1, and 2-2 were solution heat treated as described previously. This was followed by about 20% CW to a final gauge of about 7 mm. The samples were subsequently artificially aged at 200° C. for various times. The results are summarized in FIG. 19. The disclosed alloys, after applying 20% CW followed by aging treatment have a minimum yield strength of 360 MPa and a minimum total % EL of 20% and or greater. See FIGS. 19, 20A and 20B.

EXAMPLE 3

Embodiments 1, 2-1, and 2-2 were subject to a conventional artificial aging treatment followed by about 20% to about 40% CW. The cold work was applied to samples having an initial thickness of about 11 mm and about 9 mm resulting in final gauge of 7 mm and 3 mm. The results are summarized for Embodiment 1 in FIG. 21.

As demonstrated in this example, Embodiment 1 has a minimum yield strength of 330 MPa in T6 condition with a minimum total elongation of 20%. By combining the composition and method of manufacture where about 20% CW to less than 25% CW is applied after solution heat treatment and quench, and prior to aging, the minimum yield strength is about 360 MPa with a minimum total elongation of about 20%. The variant displayed a minimum yield strength after 40%-45% CW of 390 MPa with a minimum total elongation of 15%.

EXAMPLE 4

Embodiments 3 and 4 were subject to a conventional artificial aging treatment followed by about 24% to about 66% CW. The cold work was applied to samples having an initial thickness of about 10 mm and about 5 mm resulting in final gauge of about 7.5 mm, about 5.5 mm, about 3.5 mm, and about 3.3 mm. Artificial aging treatment times were varied. The samples were tested for yield strength, ultimate tensile strength, total elongation and uniform elongation. The results are summarized for Embodiment 3 in FIGS. 22, 23, 24 and 25. The results are summarized for Embodiment 4 in FIGS. 26, 27, 28 and 29.

All patents, publications and abstracts cited above are incorporated herein by reference in their entirety. Various embodiments of the invention have been described in fulfillment of the various objectives of the invention. It should be recognized that these embodiments are merely illustrative of the principles of the invention. Numerous modifications and adaptations thereof will be readily apparent to those skilled in the art without departing from the spirit and scope of the present invention as defined in the following claims.

What is claimed is:

1. A method of making an aluminum alloy sheet, comprising:

direct chill casting a 6xxx aluminum alloy to produce a direct chill cast 6xxx aluminum alloy, wherein the 6xxx aluminum alloy comprises 0.02-0.15 wt. % Cr, 0.4-1.0 wt. % Cu, 0.10-0.30 wt. % Fe, 0.8-2.0 wt. % Mg, 0.10-0.30 wt. % Mn, 0.8-1.4 wt. % Si, 0.005-0.15 wt. % Ti, 0.01-3 wt. % Zn, and up to 0.15 wt. % impurities, remainder aluminum;

homogenizing the direct chill cast 6xxx aluminum alloy at a homogenization temperature from 510° C. to 590° C.;

maintaining the direct chill cast 6xxx aluminum alloy at the homogenization temperature to produce a homogenized 6xxx aluminum alloy;

laying down the homogenized 6xxx aluminum alloy to a target laydown temperature from 420° ° C. to 480° C.;

hot rolling the homogenized 6xxx aluminum alloy to produce an aluminum alloy sheet, having a thickness up to 18 mm, wherein the aluminum alloy sheet has a hot roll exit temperature from 300° C. to 400° C.;

solution heat treating the aluminum alloy sheet at a solution heat treatment temperature from 510° C. to 590° C.;

quenching the aluminum alloy sheet from the solution heat treatment temperature to ambient temperature;

cold rolling the aluminum alloy sheet to a final gauge after quenching, wherein the cold rolling reduces the thickness of the aluminum alloy sheet in a range from 10% to 45% to the final gauge; and artificially aging the aluminum alloy sheet at an artificial aging temperature from 160° C. to 240° C. for 0.5 to 6 hours, wherein the aluminum alloy sheet has a yield strength of at least 300 MPa and an elongation of at least 10%.

2. The method of claim 1, wherein the aluminum alloy sheet is maintained at the artificial aging temperature of 200° C. for 0.5 to 6 hours.

3. The method of claim 2, wherein a % cold work (CW) in the cold rolling step is from 10% to 20%.

4. A 6xxx aluminum alloy sheet produced by the method of claim 1, wherein a minimum r/t ratio of the 6xxx aluminum alloy sheet is about 1.2 without cracking.

5. A 6xxx aluminum alloy sheet produced by the method of claim 1, wherein the 6xxx aluminum alloy sheet has a final gauge between 2-14 mm.

6. A 6xxx aluminum alloy sheet produced by the method of claim 1, wherein the 6xxx aluminum alloy sheet has a final gauge below 1 mm.

7. A method of making an aluminum alloy sheet, comprising:

continuously casting a 6xxx aluminum alloy to produce a continuously cast 6xxx aluminum alloy;

hot rolling the continuously cast 6xxx aluminum alloy to produce an aluminum alloy sheet;

solution heat treating the aluminum alloy sheet at a solution heat treatment temperature;

quenching the aluminum alloy sheet from the solution heat treatment temperature to ambient temperature;

cold rolling the aluminum alloy sheet to a final gauge after quenching, wherein the cold rolling reduces the thickness of the aluminum alloy sheet in a range from 10% to 45% to the final gauge; and artificially aging the aluminum alloy sheet at an artificial aging temperature from 160° C. to 240° C. for 0.5 to 6 hours, wherein the 6xxx aluminum alloy comprises 0.02-0.15 wt. % Cr, 0.4-1.0 wt. % Cu, 0.10-0.30 wt. % Fe, 0.8-2.0 wt. % Mg, 0.10-0.30 wt. % Mn, 0.8-1.4 wt. % Si, 0.005-0.15 wt. % Ti, 1.0-3.0 wt. % Zn, up to 0.15 wt. % impurities, and aluminum;

wherein the aluminum alloy sheet has a yield strength of at least 300 MPa and an elongation of at least 10%.

8. The method of claim 7, wherein the aluminum alloy sheet is maintained at the artificial aging temperature of 200° ° C. for 0.5 to 6 hours.

9. The method of claim 8, wherein a % cold work (CW) is from 10% to 30%.

10. A 6xxx aluminum alloy sheet produced by the method of claim 7, wherein a minimum r/t ratio of the 6xxx aluminum alloy sheet is about 1.2 without cracking.

* * * * *